US012495843B2

(12) United States Patent
Zhang et al.

(10) Patent No.: US 12,495,843 B2
(45) Date of Patent: Dec. 16, 2025

(54) FIT ADJUSTABLE NURSING BRA

(71) Applicant: Iowa State University Research Foundation, Inc., Ames, IA (US)

(72) Inventors: Ling Zhang, Ames, IA (US); Li Jiang, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 34 days.

(21) Appl. No.: 18/308,827

(22) Filed: Apr. 28, 2023

(65) Prior Publication Data

US 2023/0346049 A1 Nov. 2, 2023

Related U.S. Application Data

(60) Provisional application No. 63/363,889, filed on Apr. 29, 2022.

(51) Int. Cl.
*A41C 3/04* (2006.01)
*A41C 3/00* (2006.01)

(52) U.S. Cl.
CPC ..... *A41C 3/04* (2013.01); *A41C 3/0028* (2013.01)

(58) Field of Classification Search
CPC ..... A41C 3/04; A41C 3/0028; A41D 1/215; A41D 1/21; A41D 1/22
USPC ..... 450/36; 2/104, 912
See application file for complete search history.

(56) References Cited

U.S. PATENT DOCUMENTS 1,545,441 A * 7/1925 Newman ..... A41C 3/00 D2/707
2,152,629 A * 4/1939 Gluckin ..... A41C 3/00 450/59
2,613,355 A * 10/1952 Coleman ..... A41C 3/04 2/104
4,355,641 A * 10/1982 Dastoli ..... A41C 3/04 450/86
5,378,192 A * 1/1995 Darmante ..... A41C 3/02 450/58
5,839,942 A * 11/1998 Miller ..... A61F 7/08 450/32
6,068,538 A * 5/2000 Alleyne ..... A41C 3/02 450/58
6,083,079 A * 7/2000 Pearson ..... A41C 3/00 450/59
D475,835 S 6/2003 Hoffman et al.
7,232,359 B1 6/2007 Richardson
7,695,344 B2 * 4/2010 Nuzzo ..... A41C 3/0028 450/74

(Continued)

FOREIGN PATENT DOCUMENTS

GB 2536541 A * 9/2016 ..... A41C 3/04
WO WO-2017041024 A1 * 3/2017 ..... A41B 11/14

OTHER PUBLICATIONS

"Definition: Around." Merriam Webster. Nov. 21, 2024. https://www.merriam-webster.com/dictionary/around (Year: 2024).*

*Primary Examiner* — Grace Huang

(74) *Attorney, Agent, or Firm* — McKee, Voorhees & Sease, PLC

(57) ABSTRACT

The disclosure relates to garments, specifically adjustable maternity and nursing brassieres and tops having multiway adjustability. The brassieres disclosed herein can be adjusted at the band and straps along with the cup size and cup lining to rapidly accommodate breast changes during and after pregnancy, and particularly during breastfeeding.

5 Claims, 26 Drawing Sheets

(56) References Cited

U.S. PATENT DOCUMENTS 8,172,639 B2 * 5/2012 Swendseid ..... A41C 3/0057 450/86
8,226,454 B2 * 7/2012 Chen ..... B24B 23/04 451/449
8,337,275 B2 12/2012 Martins-Crawbuck et al.
9,022,833 B2 * 5/2015 Deming ..... A41D 13/1245 450/30
9,155,339 B2 * 10/2015 Alva ..... A61M 1/067
9,700,083 B2 * 7/2017 DeCotiis ..... A41C 3/0028
9,756,880 B1 * 9/2017 Malik ..... A41C 3/04
9,936,740 B2 * 4/2018 Howard ..... A41C 1/10
10,231,492 B1 * 3/2019 Bastug ..... A41C 3/10
10,757,984 B2 * 9/2020 Akerson ..... A41C 3/005
10,779,618 B2 * 9/2020 Gorman ..... B29C 71/02
11,241,048 B2 * 2/2022 Alva ..... A41C 3/0035
11,284,659 B2 * 3/2022 Vanos ..... A41C 3/04
11,523,640 B2 * 12/2022 Wallace ..... A41C 3/0028
11,690,411 B2 7/2023 Ironi
11,910,846 B2 * 2/2024 Stanton ..... A41C 3/04
11,957,186 B2 * 4/2024 Stanton ..... A41C 3/0014
D1,032,145 S * 6/2024 Kuderska ..... A61F 5/026 D2/709
2008/0064299 A1 * 3/2008 La Fontaine ..... A41C 3/04 450/36
2010/0068971 A1 * 3/2010 Hendrickson ..... A41C 3/04 2/104
2011/0081826 A1 * 4/2011 Hendrickson ..... A41C 3/0028 450/39
2012/0021669 A1 * 1/2012 Johnstone ..... A41C 3/02 450/86
2012/0180194 A1 * 7/2012 Cutter ..... A41F 9/025 2/237
2014/0031775 A1 * 1/2014 Criss ..... A61F 5/03 604/355
2015/0208734 A1 * 7/2015 Callahan ..... A41D 1/22 450/30
2016/0143372 A1 * 5/2016 Anderson ..... A41D 7/00 450/31
2019/0014829 A1 1/2019 Kim et al.
2021/0169152 A1 6/2021 Choudhury et al.
2021/0346591 A1 * 11/2021 Wyrick ..... A41C 3/02
2023/0000179 A1 * 1/2023 Prochner ..... A41D 1/22
2024/0423299 A1 * 12/2024 Clayton ..... A41F 15/002

* cited by examiner

FIT ADJUSTABLE NURSING BRA

TECHNICAL FIELD

The present disclosure relates generally to garments, specifically adjustable maternity and nursing brassieres having multiway adjustability. The brassieres disclosed herein can be adjusted at the band and straps along with the cup size and cup lining to rapidly accommodate breast changes during and after pregnancy, and particularly during breastfeeding.

TECHNICAL BACKGROUND

The background description provided herein gives context for the present disclosure. Work of the presently named inventors, as well as aspects of the description that may not otherwise qualify as prior art at the time of filing, are neither expressly nor impliedly admitted as prior art.

Brassieres ("bras") are an essential garment, particularly during pregnancy and breastfeeding. During breastfeeding, due to increased milk volume, there are substantial changes to the size and shape of the breasts. The shape and size of the breasts can vary frequently, as much as several times a day depending on milk volume.

In general, traditional bras are configured to accommodate foam pads and metal wires inside of the cups. Most foam cups are made out of rigid polyurethane and reinforced with a metal underwire, but such bra cups fail to meet the demands of nursing as they lack adjustability and are often uncomfortable. In particular, the metal underwire customarily attached at the base of the bra band can irritate sensitive breasts. Beyond simple discomfort, wearing an ill-fitting or inflexible bra may cause serious diseases, such as obstructed milk ducts, breast engorgement, and mastitis.

Existing nursing bras were designed to provide a comfortable and safe breastfeeding experience. There are two major categories of nursing bras: cut-and-sew bras and seamless knitted bras. The cut-and-sew bras are configured as open cups with special clipped closures on the front of the shoulder straps. The cups can be pulled down or to the side of the torso to expose the breast for breastfeeding. The seamless knitted nursing bras are made out of highly stretchable spandex yarns and knitted by a circular weft knitting machine. These bras fit circularly around the body without including separate panels. The cups of nursing bras are configured as open cups with clipped closures on the shoulder straps to enable ease of access for nursing.

However, these nursing bras suffer from several significant deficiencies. The style and function of typical nursing bras do not offer true flexibility or comfort for individuals who face regular changes to their breasts and bodies. For example, traditional cut-and-sew nursing bras do not permit adjustment to the cup size and permit only minimal adjustment to the band size, often through the selection of larger or smaller eyelet hooks at the bra clasp. The cut-and-sew nursing bras, therefore, do not provide an adjustable fit. This lack of adjustability requires the wearer to purchase multiple bras in different sizes, but even with multiple bras, the wearer cannot adjust the cut-and-sew bra during the day as breast volume and sensitivity change.

Even though the seamless knitted nursing bras are more flexible than cut-and-sew bras (in the sense that they provide more stretch) since the seamless bras are typically one continuous piece of fabric, they are not adjustable. Additionally, the tension of the yarns and knitting structure can cause fit issues on the cups and unnecessary pressure against the sensitive breasts. Further, it can be difficult to put on and take off traditional seamless bras.

To accommodate changing cup and body size, it is often necessary to buy multiple cut-and-sew bras. Thus, there exists a need to develop nursing and maternity garments that are easily adjustable.

More particularly, there is a need to develop nursing and maternity bras that are adjustable in multiple ways, namely in the cup size, the cup lining, the strap length and configuration, and the band size, among other things.

There is also a need to develop nursing and maternity bras that are comfortable and adequately support the breasts without requiring an underwire or a center gore or bridge.

These and other objects, advantages, and features of the present disclosure will become apparent from the following specification taken in conjunction with the claims set forth herein.

BRIEF SUMMARY

An advantage of the instantly disclosed bras is that they overcome the deficiencies of traditional cut-and-sew and seamless nursing bras, in particular providing easy adjustment of multiple parts of the bra, such as the configuration of the bottom band to fit the changes in body weight and torso shape postpartum. In particular, the bra cups are gathered at the bottom seams to give more room for breast size change when expanded during lactation. Further, the cups include two layers, wherein each cup provides full coverage for both support and privacy. The foam pads are removable providing multiple options to wear during daytime and nighttime. The supporting inner liners of the bra are configured to be multi-functional. Firstly, the liners connect the cups to the shoulder straps. In some embodiments, when the cup is flipped down to expose the breast, the liner still attaches to the shoulder strap. Secondly, the liner is a piece that attaches to the cups at the bottom seam. The shape of the liners goes around the under part of the breasts to provide support to the heavy breasts. Additionally, the bra cups can be opened in two ways: opening on either side of the front shoulder straps and opening on either side of the front bottom band. Instead of having elastic on the bottom band, as the traditional nursing bra does, the embodiments described herein use double layers of self-fabric to create a wide bottom band that gives a comfortable feel to nursing mothers. Soft Velcro® (hook and loop fastener) is attached to the bottom band and the bottom band belts to allow easy access to opening the vertically oriented bottom band, thus permitting adjustability for a proper fit around the torso. In some embodiments, three flat elastics are horizontally attached at the inside of the bottom band to provide extra support for the bottom band and make it more secure on the torso. Three rolls of the flat elastics at the center front area provide flexibility to the bottom band to comfortably fit around the torso and easily adjust the adjustable bottom band wings.

The following objects, features, advantages, aspects, and/or embodiments, are not exhaustive and do not limit the overall disclosure. No single embodiment needs to provide every object, feature, or advantage. Any of the objects, features, advantages, aspects, and/or embodiments disclosed herein can be integrated with one another, either in full or in part.

The present disclosure relates to a garment, particularly a bra, comprising a band configured to extend around a body of a wearer, a first cup connected to the band, a second cup connected to the band, a first shoulder strap releasably connected to the first cup by a first clasp set, a second shoulder strap releasably connected to the second cup by a second clasp set, one or more supports releasably connected to the band, and one or more band fasteners configured to connect the one or more supports to the band. In some embodiments, the band comprises an opening. In some embodiments, the one or more supports comprise a continuous wing and a bottom band comprising a first detachable portion and a second detachable portion.

According to an embodiment, the one or more band fasteners comprise a first band fastener and a second band fastener; wherein the first detachable portion of the bottom band passes through the opening on the band and is releasably connected to the band, and the first detachable portion of the bottom band by the first band fastener; and wherein the second detachable portion of the bottom band passes over the first detachable portion of the bottom band and is releasably connected to the band and the second detachable portion of the bottom band by the second band fastener.

In some embodiments, the garment further comprises an elastic belt attached to the band. In an embodiment, the garment further comprises a first cup support and a second cup support. According to some embodiments, the first clasp set comprises a first bottom component attached to the first shoulder strap and the first cup support, and a first top component attached to the first cup; and wherein the second clasp set comprises a second bottom component attached to the second shoulder strap and the second cup support, and a second top component attached to the second cup. In further embodiments, the one or more supports comprise a first support wing and a second support wing.

In some embodiments, the garment further comprises a first retaining strap, a second retaining strap, a first stabilizer panel, and a second stabilizer panel; and wherein the one or more band fasteners comprise a first band fastener and a second band fastener. In a further embodiment, the first retaining strap is connected to the first shoulder strap via the first clasp set and the first stabilizer panel; wherein the second retaining strap is connected to the second shoulder strap via the second clasp set and the second stabilizer panel. In a still further embodiment, the first stabilizer panel is connected to the first cup, the band, and a first back wing; and wherein the second stabilizer panel is connected to the second cup, the band, and a second back wing.

According to an embodiment, the garment further comprises a hook and eye closure system, wherein the first back wing, the second back wing, and the band open and close around the body of the wearer via the hook and eye closure system.

In some embodiments, the first support wing crosses across the body of the wearer in a first direction and is releasably connected to the band by the first band fastener; and wherein the second support wing crosses across the body of the wearer in a second direction and is releasably connected to the band by the second band fastener.

In further embodiments, the first clasp set comprises a first bottom component attached to the first shoulder strap and the first retaining strap, and a first top component attached to the first cup; and wherein the second clasp set comprises a second bottom component attached to the second shoulder strap and the second retaining strap, and a second top component attached to the second cup.

In still further embodiments, the one or more supports comprise a support panel, a first back wing and a second back wing connected to opposite sides of the support panel; and an waistband comprising a first detachable portion and a second detachable portion wherein the waistband is connected to the support panel, the first back wing, and the second back wing.

According to an embodiment, the first clasp set comprises a first bottom component and a second bottom component attached to the first shoulder strap and a first side of the support panel, a first top component attached to the first cup, and a second top component attached to the first detachable portion of the waistband; and wherein the second clasp set comprises a third bottom component and a fourth bottom component attached to the second shoulder strap and a second portion of the support panel, a third top component attached to the first cup, and a fourth top component attached to the second detachable portion of the waistband.

In some embodiments, the one or more band fasteners comprise a first band fastener and a second band fastener; wherein the first band fastener releasably connects the band and the first detachable portion of the waistband; and wherein the second band fastener releasably connects the second detachable portion of the waistband to the first detachable portion of the waistband.

In an embodiment, the garment further comprises a hook and eye closure system, wherein the first back wing, the second back wing, and the waistband open and close around the body of the wearer via the hook and eye closure system.

According to a further embodiment, the garment further comprises a skirt connected to the waistband.

In a still further embodiment, the garment further comprises one or more elastic bands attached to the one or more supports.

These and/or other objects, features, advantages, aspects, and/or embodiments will become apparent after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

As shown in FIG. 3, the removable cups comprise a removable foam pad inside of each cup between two layers of the fabric. The cups can be removed from the curved opening at the side of the inner layer of the cup.

FIG. 15A shows a skirt attached to the nursing bra, FIG. 15B shows a knee-length skirt attached to the nursing bra, and FIG. 15C shows a floor-length (i.e. "maxi") skirt attached to the nursing bra.

FIG. 22 shows the top component of the clasp 19*b* and the bottom component of the clasp 19*a* separately, and also the clasp set 20 when the top component of the clasp 19*b* and the bottom component of the clasp 19*a* are joined.

In FIG. 23, the top component of the clasp 19*b* is connected with the lower bottom component of the clasp 19*a*, while the upper bottom component of the clasp 19*a* remains free. Optionally, to facilitate adjustment of the cup 1 (not shown) size, the top component of the clasp 19*b* can be connected with the upper bottom component of the clasp 19*a*. Alternatively or in addition to this configuration, the skirt 22 (not shown) and/or fabric of the cup 1 (not shown) can be connected to the upper bottom component of the clasp 19*a* by way of a top component 19*b* attached to the waistband 21 (not shown).

Figure 1:
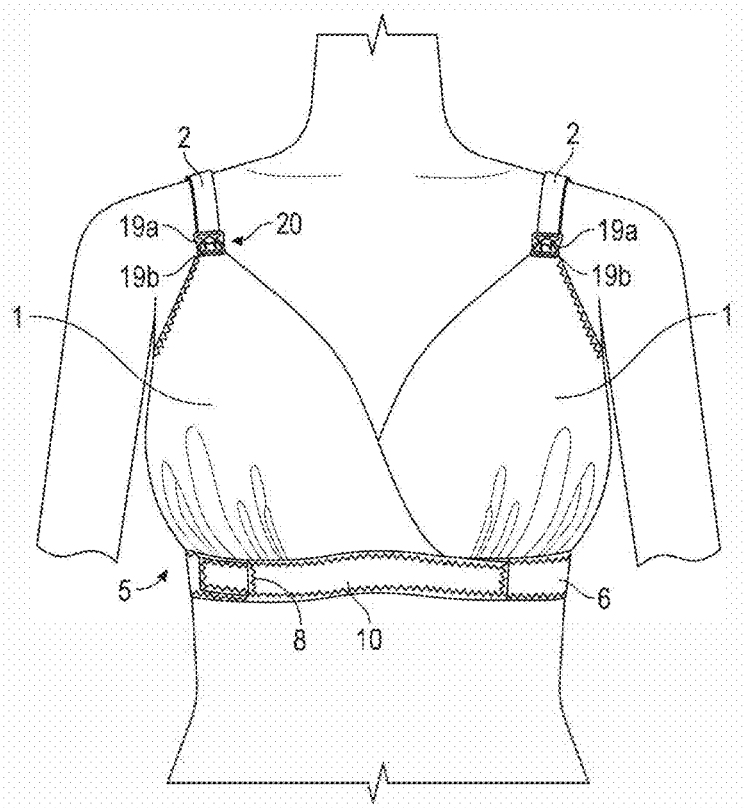
FIG. 1 is a front perspective view of the outside of the adjustable bottom band nursing bra according to the present disclosure.

The select embodiments described herein are not limiting; it will be appreciated that each of the features explicitly described herein and their equivalents may be combined together in a number of distinct permutations.

DETAILED DESCRIPTION OF THE PREFERRED EMBODIMENTS

The present disclosure is not to be limited to that described herein. Changes can be made without departing from the spirit and scope of the present disclosure. No features shown or described are essential to permit the basic operation of the present disclosure unless otherwise indicated. All terminology used herein is to describe particular embodiments only and is not intended to be limiting in any manner or scope. For example, as used in this disclosure, the singular forms "a," "an" and "the" can include plural referents unless the context indicates otherwise. Unless indicated otherwise, "or" can mean any one element alone or any combination thereof, e.g., "A, B, or C" means the same as any of A alone, B alone, C alone, "A and B," "A and C," "B and C" or "A, B, and C." Further, all units, prefixes, and symbols (e.g., inches) may be denoted in their SI accepted form.

Numeric ranges recited within the specification are inclusive of the numbers defining the range and include each integer within the defined range. Throughout this disclosure, various aspects of this disclosure are presented in a range format or a series of example measurements. It should be understood that the description in range or example measurement is merely for convenience and brevity and should not be construed as an inflexible limitation on the scope of the disclosure. Accordingly, the description of a range should be considered to have specifically disclosed all the possible sub-ranges, fractions, and individual numerical values within that range. For example, a description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6, and decimals and fractions, for example, 1.2, 3.8, 1½, and 4¾. Similarly, a series of example measurements should be understood to incorporate each integer falling within the upper limit and lower limit of the example measurements. For example, discussion of 1 inch, 2 inches, and 10 inches includes 1 inch, 2 inches, 3, inches, 4 inches, 5 inches, 6 inches, 7 inches, 8 inches, 9 inches, 10 inches, and decimals and fractions therein (e.g., 1.5 inches). This applies regardless of the breadth of the range.

So that the present disclosure may be more readily understood, certain terms are first defined. Unless defined otherwise, all technical and scientific terms used herein have the same meaning as commonly understood by one of ordinary skill in the art to which embodiments of the disclosure pertain. Many methods and materials similar, modified, or equivalent to those described herein can be used in the practice of the embodiments of the present disclosure without undue experimentation, the preferred materials and methods are described herein. In describing and claiming the embodiments of the present disclosure, the following terminology will be used in accordance with the definitions set out below.

The term "about" as used herein refers to slight variations in numerical quantities with respect to any quantifiable variable. Inadvertent error can occur, for example, through the use of typical measuring techniques or equipment or from differences in the manufacture or source of components. Regardless of whether the word "about" is explicitly included, this disclosure covers embodiments and components having slight variations in numerical quantities, measurements, sizes, and the like.

The term "generally" can refer to a common use or practice, and can also refer to a plurality, majority, and/or a supermajority of a quantifiable variable, based on context.

The term "configured" describes structures capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, sub-combinations, or the like that would be obvious to those skilled in the art.

As used here, the term "self-fabric" refers to a fabric piece or component made from the same fabric as the primary fabric, as opposed to contrast fabric. Self-fabric pieces can be used as liners and/or to provide additional support or tensile strength.

Adjustable Nursing Bra

To solve the issues of the traditional cut and sew and seamless nursing bras, there is a need for a nursing bra that allows a mother to feel comfortable, wear the product easily, and adjust the configuration at the bottom band to fit the changes of her body weight and torso shape postpartum.

The adjustable nursing bra described herein has cups gathered at the bottom seams to provide more (or less) room for breast size changes when the breasts are full. There are two layers of fabric for the cups, and each cup provides full coverage to protect the wearer's privacy and support larger and/or heavier breasts. There is one foam pad between the layers of each bra cup. The foam pads are removable from the curve opening on the outer side seam of the inner layer of the cups. The supporting inner liners of the adjustable bra described herein are configured to achieve multiple purposes. Firstly, the liners hold the cups to the shoulder straps. When the cup is flipped down to expose the breast, the liner still attaches to the shoulder strap. Secondly, the liner also attaches to the cups at the bottom seam. The shape of the liners goes around the under part of the breasts to provide support for large and/or heavy breasts.

The bra cups of the adjustable bra described herein can be opened in two ways: opening on either side of the front shoulder straps; and opening on either side of the front part of the support belt. The support belt may comprise elastic to provide flexible stretch and account for changing torso size. However, in some embodiments, instead of having elastic on the bottom band, the disclosure described herein uses double layers of self-fabric to create a wide bottom band that provides a softer, more comfortable feel. A band fastener, preferably Velcro® (hook and loop fastener), is attached to the bottom band and the support wings to allow easy access to opening the vertically oriented bottom band, thus permitting easy adjustments for a proper fit around the torso. In an embodiment, where the band fastener comprises Velcro® (hook and loop fastener), the hook portion of the Velcro® (hook fastener) is positioned on the support belt.

In some embodiments, the adjustable nursing bra has one or more elastic bands attached at the inside of the bottom band to provide extra support for the bottom band and make it more secure on the torso. In a preferred embodiment, the adjustable nursing bra has three flat elastic bands horizontally attached at the inside of the bottom band. In particular, three bands of flat elastic at the center front of the bra between and underneath the cups and support wings add flexibility to the bottom band, permitting comfort for different torso sizes and easy adjustability of the support wings.

Referring now to the figures, FIG. 1 shows a front perspective view of the adjustable nursing bra, wherein the nursing bra has two bra cups 1, two shoulder straps 2, two strap length adjusters 4 (not shown), and one or more clasp sets 20. Each clasp set may comprise one or more bottom components 19*a* and one or more top components 19*b*, for example, one bottom component 19*a* and one top component 19*b*; or two bottom components 19*a* and one top component 19*b*. The bra also includes a bottom band 6 attached to the base of the bra which goes around the circumference of the torso. According to FIG. 1, in an embodiment, the bottom band includes detachable portions (28, 29) of the bottom band which overlap with one another to secure the bra to the torso, along with a support belt 10. The support belt includes an opening 8, preferably a slit between 0.5 inches to 3 inches, more preferably a slit of about two inches. In such an embodiment, one of the detachable parts of the bottom band 6 passes through the opening 8 on an opposite detachable part of the bottom band 6, permitting the detachable portions of the bottom band 6 to overlap. The bra cups 1 are overlapped at the center from of the bra via attachment to the bottom band 6. The strap length adjusters 4 (not shown), preferably slides, can be positioned on the shoulder strap above the cup or, if present, on the part of the should strap below the clasp set. In a preferred embodiment, the cups 1 include cup gathering 5 at the base of the cups 1 where the cups 1 meet the bottom band 6. The gathering of the fabric in the cups 1 permits flexibility for breast size changing throughout the day.

In a preferred embodiment of the adjustable bra, the bra cups are lined. The two layers of fabric provide more protection and support to the breasts. The bra cups 1 may be of any suitable size, including but not limited to extra small, small, medium, large, extra-large, double extra-large, or numerical cup sizes AAA through H. In a preferred embodiment, bra cups 1 are wire-free. The bottom band 6 may be any suitable length and is configured to provide support to the cups 1 and hold the shape of the cups 1. The entire bottom band 6 preferably has two layers of fabric. In an embodiment, the top layer is the same fabric as the cups, and the bottom layer, which is close to the skin, is either the same fabric as the cups or is made of a stretchy but supportive material, such as power mesh, which provides much support for the breasts.

In a preferred embodiment, the strap length adjusters are preferably slides. Further, the shoulder straps 2 may be of any width (e.g., 5/16 inch, 3/8 inch, half-inch, three-quarter inch, and the like). In determining the size of the shoulder straps 2, the width of the shoulder straps 2 should be wide enough to hold the weight of the breasts across the shoulders without cutting into the skin. Shoulder straps may be made of containing elastic or any other comfortable material. The shoulder straps 2 are connected to the cups 1 and cup supports 7 via one or more clasp sets 20. The cups can be opened and closed via the bottom component of the clasp 19*a* and the top component of the clasp 19*b*, permitting a wearer to use one hand to flip down the cup for breastfeeding. The length of shoulder straps 2 can be adjusted using the strap length adjusters 4 (not shown) attached to the cups 1 and the top edge of the back continuous wing 12 (not shown).

Figure 2:
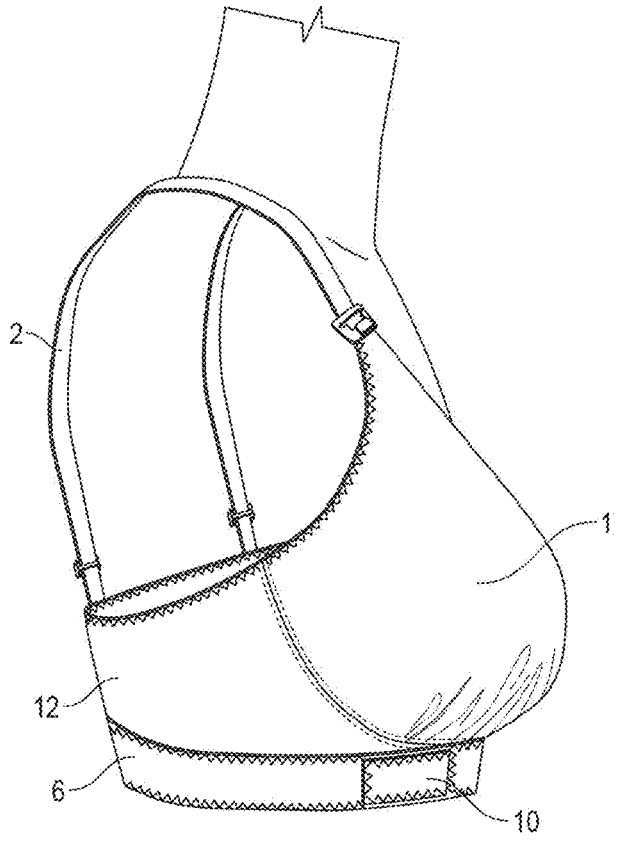
FIG. 2 is a side perspective view of the outside of the adjustable bottom band nursing bra according to the present disclosure.

FIG. 2 is a side perspective view of the outside of the adjustable bottom band nursing bra according to the present disclosure, depicting one of the cups 1, a shoulder strap 2, the back of the bottom band 6, and a termination point of the support belt 10. FIG. 2 also shows the continuous wing 12. The continuous wing may have seams or other means to adjust the wing, however, it does not split into two parts joined by clasps or closure systems. Preferably, the continuous wing is made of the same material as the cups.

Figure 3:
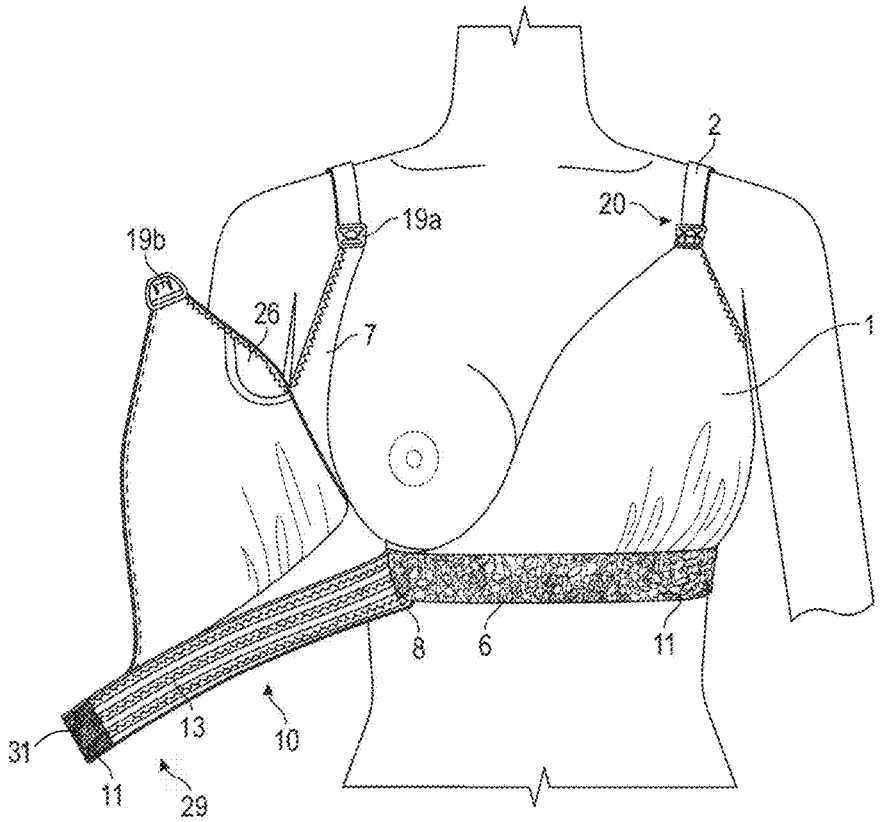
FIG. 3 is a front perspective view of a cup opening embodiment of the liner, the removable cups, and inside the bottom band according to the present disclosure.

FIG. 3 is a front perspective view of the adjustable bra where one of the cups is opened. FIG. 3 illustrates how the bra cups 1 open via the clasp set 20 (i.e., the bottom component of the clasp 19*a* and the top component of the clasp 19*b*), and how the bottom band 6 is configured to be adjustable. As shown in FIG. 3, the bottom band 6 may include an elastic belt 13 attached to the inside of the bottom band 6. This configuration provides a strong support to the bottom band 6 around the torso and increases the friction on the fabric. The bottom band 6 also includes an opening 8, preferably a slit about two inches wide. The first detachable portion 28 of the bottom band 6 opposite to the opening 8, can pass through the opening 8, permitting adjustment of the circumference of the bottom band 6. The detachable portions (28, 29) of the bottom band 6 are secured with any suitable fastener, preferably Velcro® (hook and loop fastener). When Velcro® (hook and loop fastener) is used, the rough (also called "hook" fastener) or soft surface Velcro® (loop fastener) is configured to be on the bottom band 6 positioned near the torso. The complementary type of Velcro® (hook or loop fastener) is then configured to be on the support belt 10 (which attaches and detaches from the bottom band 6). The Velcro® (hook and loop fastener) or other suitable material comprising the band fastener 11 may be provided in short strips or pieces on the bottom band 6 and/or support belt 10. Alternatively, the Velcro® (hook and loop fastener) or other suitable material comprising the band fastener 11 may be larger, spanning the front of the torso or spanning the circumference of the torso, when positioned on the bottom band 6. The bra also includes a cup support 7, an inner liner that holds the shoulder straps 2 when the cups 1 are opened and provides extra support to the breasts, enhancing the visual aesthetics of the breast shape. The cup supports 7 are connected to the shoulder straps 2 and the cups 1, and optionally other parts of the bra, such as the bottom band 6 and/or the back wing 15 (not shown). The cups 1 further include a cup opening 26 to receive removable pads (not shown) preferably foam pads. The removable pads are inserted into each cup between the inner liner of the cup and the outer layer (front) of the cup. The cup foam pads can be removed or inserted based on the preference of the wearer via the cup openings 26. For example, the removable pads 27 can be removed during the nighttime and inserted during the day. FIGS. 4, 5, 7, and 10 also depict the cup openings 26, although the cup openings and removable pads 27 are optional features of the adjustable nursing bra.

Figure 4:
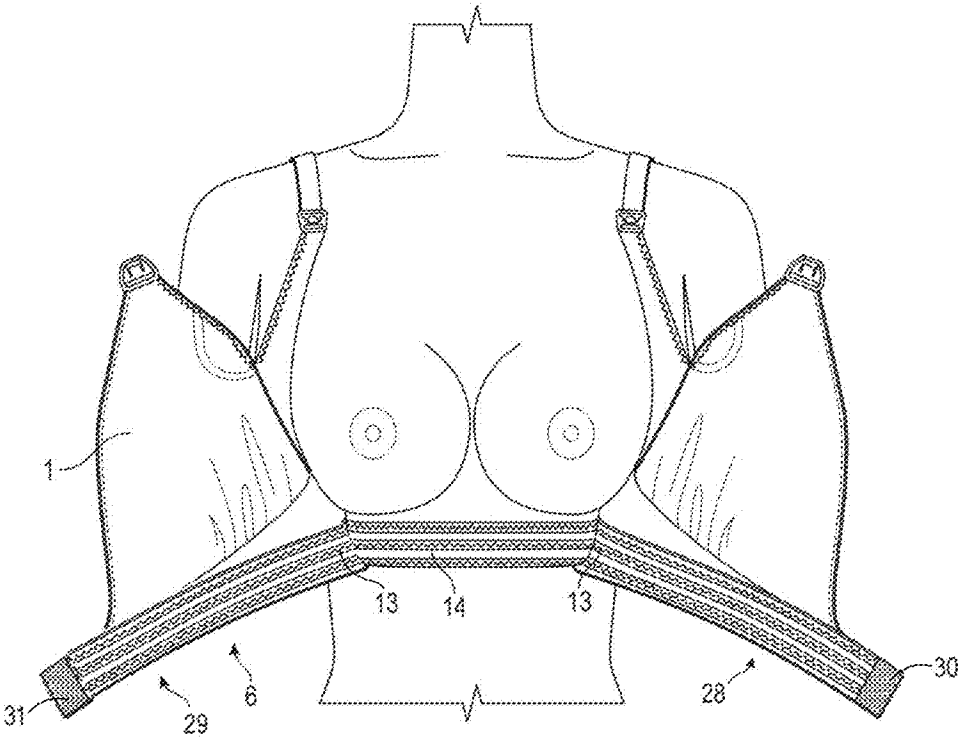
FIG. 4 is a front perspective view of two cup opening embodiment of three rolls of flat elastic according to the present disclosure.

FIG. 4 is a front perspective view of the adjustable nursing bra wherein both cups 1 are opened. Further, as shown in FIG. 4, the bra can include an elastic band 14 which connects the bottom band 6, preferably at the center front of the bra, together with an elastic belt 13 attached to the detachable portions (28, 29) of the bottom band. The elastic band 14 can be comprised of one or more, for example three rolls of flat elastic to hold the shape of the bottom band 6, and also to enable adjustment of the bra band size while the cups 1 are opened.

Figure 5:
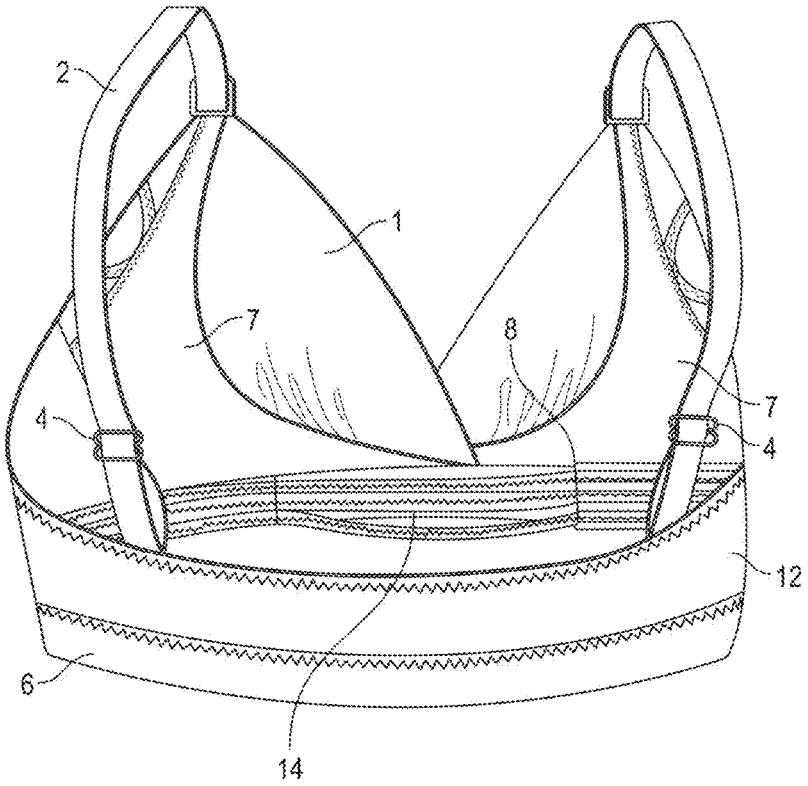
FIG. 5 is a rear perspective view of the inside of the adjustable bottom band nursing bra according to the present disclosure.

FIG. 5 is a rear perspective view of the adjustable nursing bra according to the present disclosure, along with an illustration of the inside of the bra (i.e., the side resting on the skin). As shown in FIG. 5, the bra includes the bottom band 6 and the continuous wing 12 which are connected to the cups 1. In some embodiments, the strap length adjusters 6 can be positioned on the shoulder straps 2 near the back of the bra. The front of the bra is supported by the cup supports 7, elastic band 14, and the adjustability provided by the opening 8.

Figure 6:
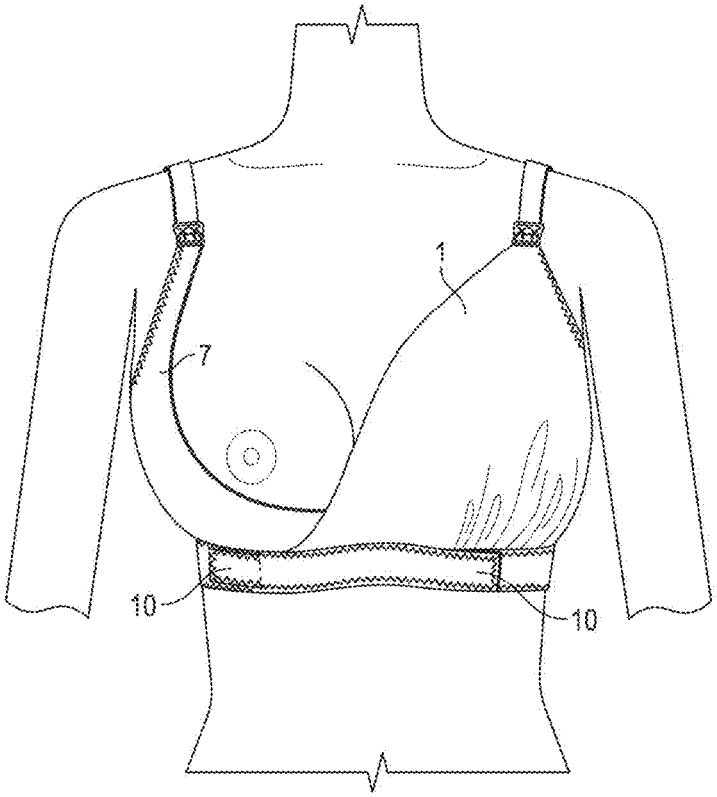
FIG. 6 is a front perspective view of the cup support on the right breast without the cups according to the present disclosure.

FIG. 6 is a front perspective view of the cup support 7 on the right breast without the cup 1, and a further depiction of the support belt 10 when fastened around the torso.

Figure 7:
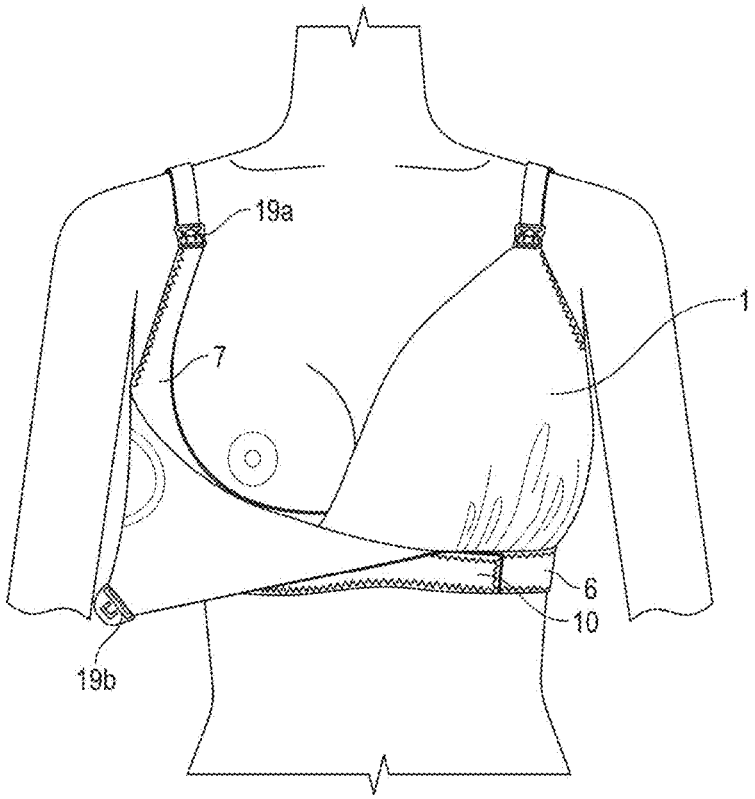
FIG. 7 is a front perspective view of flipping down the cup with the closed bottom band, and the configuration of the optional removable cups according to the present disclosure.

FIG. 7 is a front perspective view showing the cup 1 opened while the bottom band 6 and support belt 10 remains fastened around the torso. The cup 1 can be opened and closed by attaching the top component of the clasp 19*b* to the bottom component of the clasp 19*a*. The cup support 7 is in place to provide support to the breast while the cup 1 is open.

Figure 8:
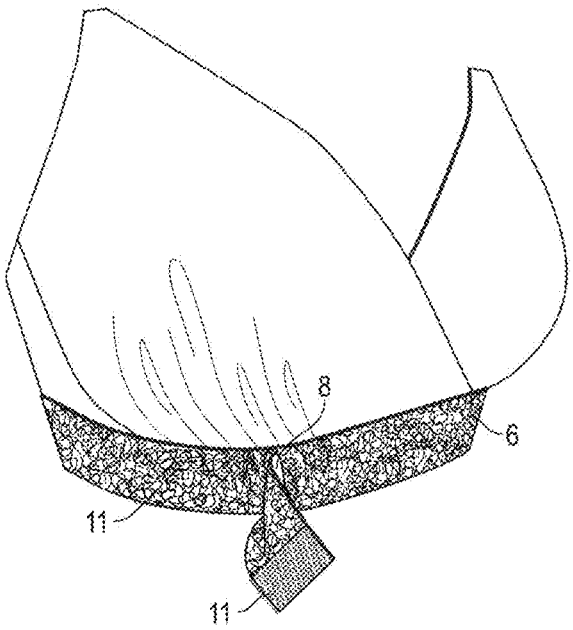
FIG. 8 is a detailed view of the Velcro® (hook and loop fastener) closure and the bottom band adjustable system.

FIG. 8 is a detailed view of an embodiment of a band fastener 11. As shown in FIG. 8, complementary portions of a band fastener 11 are contacted after the first detachable portion 28 of the bottom band 6 passes through the opening 8. In FIG. 8, the band fastener 11 is Velcro® (hook and loop fastener), but the band fastener can be any material or device that connects one portion of fabric to another portion of fabric, such as a snap, a hook, a clasp, and the like. In FIG. 8, the rough or soft surface Velcro® (hook and loop fastener) is configured to be on the bottom band 6 positioned near the torso. The complementary type of Velcro® (hook and loop fastener) is then configured to be on a detachable portion (28, 29) of the bottom band 6. The Velcro® (hook and loop fastener) or other suitable material comprising the band fastener 11 may be provided in short strips or pieces on the bottom band 6. Alternatively, the Velcro® (hook and loop fastener) or other suitable material comprising the band fastener 11 may be larger, spanning the front of the torso or spanning the circumference of the torso, when positioned on the bottom band 6.

Adjustable Nursing Bra with Support System

In addition to adjustability, there is a need to provide a nursing bra that has an additional support system. Extra support and coverage are particularly desirable for individuals with large or heavy breasts. As an example, an adjustable bra with a support system includes bra cups that are gathered at the bottom seams to allow more room for breast size change when the breasts are full of breastmilk. Preferably, there are two layers of fabric for the cups, and each cup provides full coverage to protect the mother's privacy and support the heavy breast. Additionally, the bra includes retaining straps and support wings which are configured to provide an extra support system to stabilize heavy breasts within the bra cups.

The support wings may be attached on both sides of the cups, starting from the side seams, the point where the fabric is connected to the back wing(s). The two support wings overlap at the center front of the bra and close at the front bottom band using a band fastener such as Velcro® (hook and loop fastener). For example, soft Velcro® (hook and loop fastener) may be attached to the bottom band and the terminal point of the support wings to allow the wearer to find the most efficient supporting position for the breasts. The support wings can be fully opened while the cup is unclipped for breastfeeding. Alternatively, the cup could be open, but the support wings closed to provide continuing support to the breast while breastfeeding. The fabric of the support wings could be stretch lace as the outer layer with power mesh as the lining.

The retaining straps are positioned in the interior of the cups. The purpose of having the retaining straps is to hold the shoulder straps firmly against the body while the cups are flipped down. In order to provide more support to the side of the breast, the retaining straps may be connected with a side panel that is made of a non-stretched stabilizer. The material of the retaining straps could be double layers of power mesh. The power mesh could provide more support and comfort to the wearer.

Overall, in addition to cup and band adjustability, the added support system of the adjustable nursing bra permits multiple supportive positions for the breasts by reliance on the size and shape of the bra cups, the support wings, the non-stretch stabilizer panel on the side of the inner bra, and/or the retaining straps.

Figure 9:
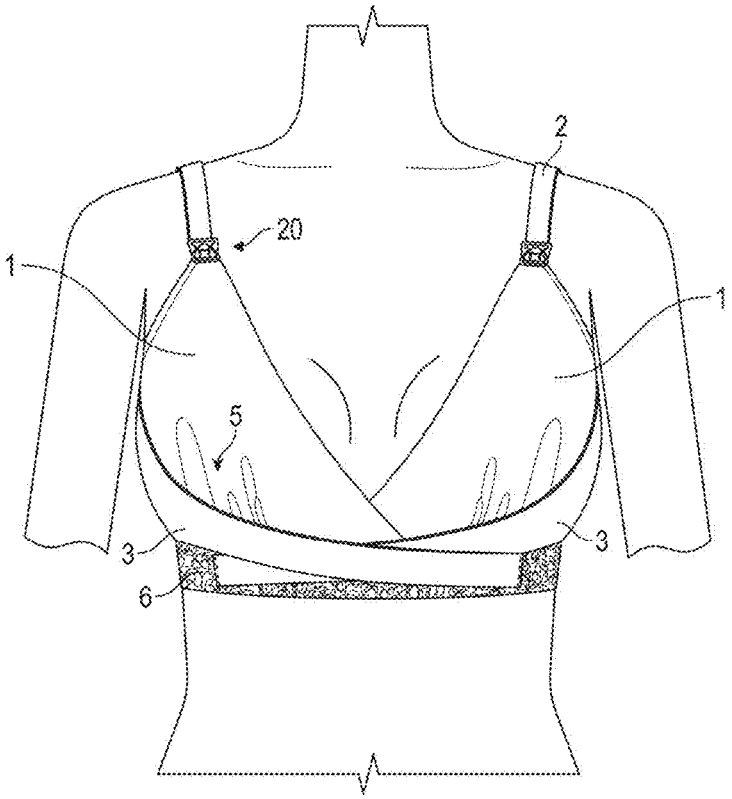
FIG. 9 is a front perspective view of the outside of the adjustable cup and support system nursing bra according to the present disclosure.

Referring now to the figures, FIG. 9 is a perspective view of the outside of the adjustable cups and support system nursing bra. The bra has two bra cups 1, two shoulder straps 2, two strap length adjusters 4 preferably attached on the back of shoulder straps, one or more clasp sets 20 attached on the shoulder straps 2 and close to the bra cups 1, two support wings 3 attached on the side seams of the bra, and a bottom band 6.

The two bra cups 1 overlap at the center front center of the bra via the bottom band 6 such that they can hold the breasts. The cups optionally have cup gathering 5 at the center of the bottom seams, where the cups 1 are attached to the bottom band 6 to provide flexibility to fit on multiple sizes of breasts. In some embodiments, there are two layers of fabric to give more protection and support to the breasts. The bra cups 1 may be of any variable size, including but not limited to extra small, small, medium, large, extra-large, double extra large, or numerical cup sizes AAA through H. In preferred embodiments, the bra cups are wire-free. The bottom band 6 is configured to provide support to the cups and hold the shape of the cups. In preferred embodiments, the entire bottom band has two layers of fabric.

In an embodiment, the supported adjustable bra has no elastic attached to the bottom band 6. In some embodiments, elastic is present on the bottom band 6. In some embodiments, each terminal end of the support wings 3 includes a band fastener. In an embodiment, the band fastener may comprise a hook or a tie. In another embodiment, the band fastener comprises Velcro® (hook and loop fastener). In an embodiment where Velcro® (hook and loop fastener) is used as the band fastener, the bottom band 6 and support wings 3 comprise complementary types of Velcro® (hook and loop fastener), enabling the support wings 3 to adjustably attach to, and detach from, the bottom band 6. Preferably, the soft Velcro® (loop fastener) is 0.5 inches to four inches wide, more preferably three inches wide, with any suitable length. For example, the Velcro® (hook and loop fastener) attached to the bottom band 6 may be one or more short strips (1-3 inches long) or the Velcro® (hook and loop fastener) may span the front of the torso or the circumference of the torso. In an embodiment, the soft surface Velcro® (loop fastener) is attached to the bottom band 6 so that during breastfeeding the infant's body will not contact the rough side of the Velcro® (hook fastener), i.e., the soft Velcro® may touch the infant's skin. The rough hook Velcro® (hook fastener) is preferably 0.5 inches to 3 inches wide, preferably about ⅝ inches wide, and attached on the inside of the terminal point of the support wings 3. The configuration of the Velcro® (hook and loop fastener) allows the wearer to adjust the fit of the support wings around the breasts.

Figure 10:
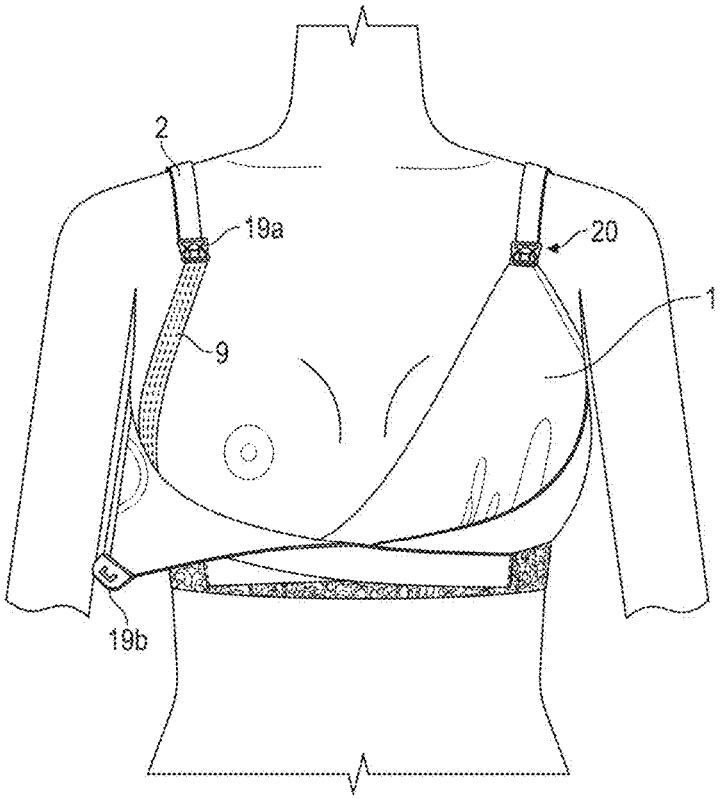
FIG. 10 is a front perspective view of the cups, where one of the cups is flipped down according to the present disclosure.

As shown in FIG. 10, the nursing bra has two shoulder straps 2 that may be of any width, including, without limitation, 5/16 inches, ⅜ inches, ½ inches, ¾ inches, and so forth. In determining the size of the shoulder straps, the width of the shoulder straps should be wide enough to hold the weight of the mother's breasts across the shoulders without cutting into the skin. The shoulder straps may be made of any suitable strong and stretchy material, such as an elastic, to provide comfort to the mother. The shoulder straps 2 are connected to the retaining straps 9 and cups 1 via one or more nursing bra clasp sets 20 comprising a bottom component 19*a* and a top component 19*b*. The bra clasp set is preferably a clip closure. The cups can be unhooked by detaching the top component of the clasp 19*b* from the bottom component of the clasp 19*a*, permitting the wearer to use one hand to flip open the cup 1 for breastfeeding. The length of shoulder straps 2 can be adjusted using the strap length adjuster 4 (not shown) on the back. The shoulder straps 2 are attached on the top edge of the back wings 15 (not shown). The back wing 15 may be made of the same fabric as the cups and/or may be made of any suitable strong and stretchy material, such as power mesh.

Figure 11:
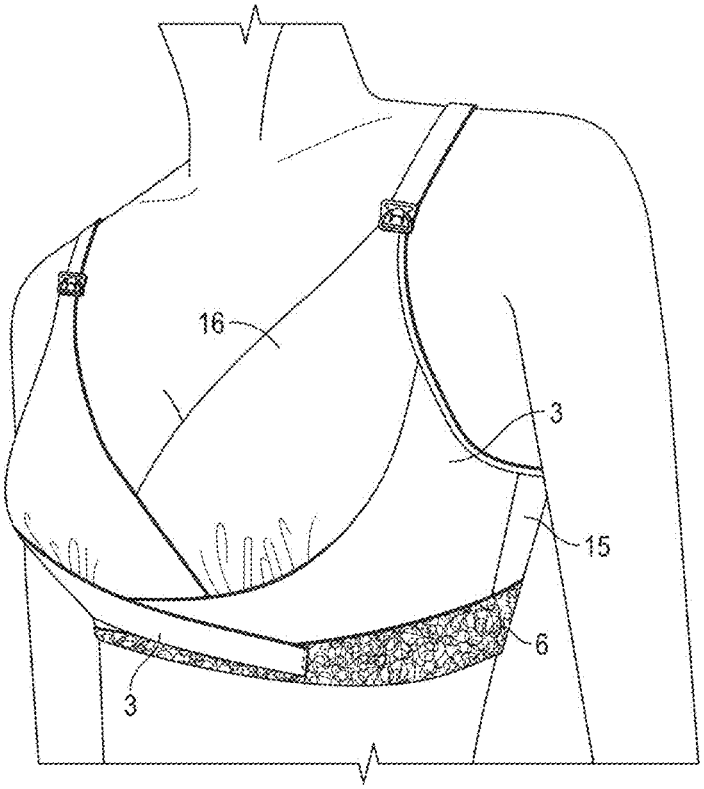
FIG. 11 is a three-quarter perspective view of the outside of the adjustable cup and support system nursing bra according to the present disclosure.

FIG. 11 shows a side view of the supported nursing bra, illustrating the configuration of the back wings 15. The back wings 15 are positioned above and attached to the bottom band 6. The back wings 15 are preferably made of two or more layers of at least one stretchy and strong material, such as double layers of power mesh, or a layer of stretch lace as the outer layer and power mesh on the inner layer. The support wings 3 are attached at the side seams to the bra cups 1 and the back wings 15.

Figure 12:
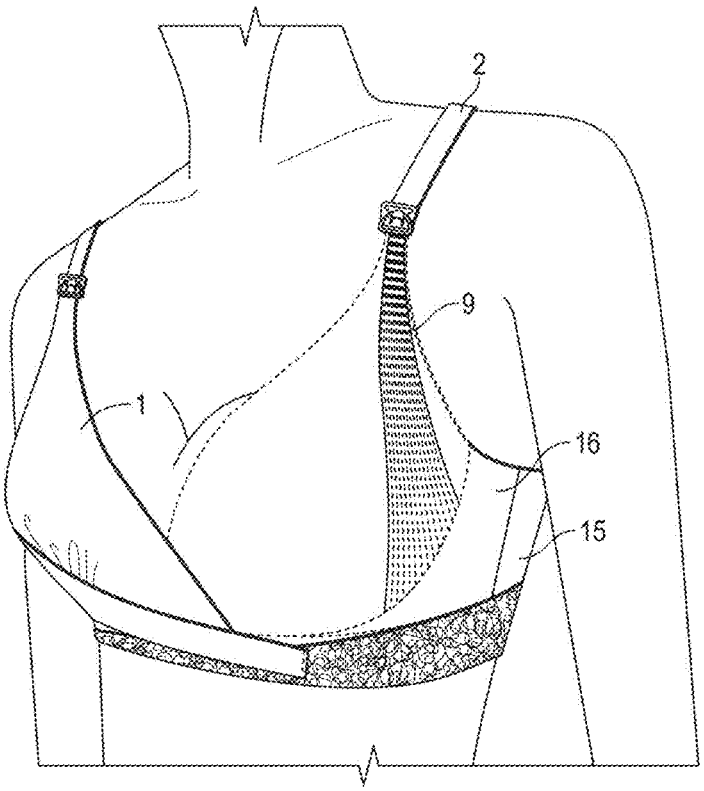
FIG. 12 is a three-quarter perspective view of the position of the retaining strap underneath the bra cup according to the present disclosure.

FIG. 12 shows a more detailed depiction of the retaining straps and an example configuration of the bra under the cups 1. The retaining straps 9 span between the top of the cup, connecting to the cups 1 and the shoulder straps 2 at the shoulder straps 2, down to the base of the cups 1, connecting with the cups 1 and/or a stabilizer panel 16. Preferably the retaining straps are positioned between the inner lining and the outer layer of the cups 1. The retaining straps 9 may be made of any suitable stretchy and/or sturdy material and preferably include two more layers of fabric, such as double layers of power mesh. The positioning of the retaining straps 9 and the use of double layers of a sturdy fabric in the same beneficially provide extra support to the breasts and prevent the fabric from rolling, a common problem with traditional nursing bras. Between the cups 1 lining and the back wings 15, there is preferably a stabilizer panel 16 that provides extra support to the side of the breasts. Preferably, the stabilizer panels 16 are comprised of a non-stretch material. The size of the stabilizer panels 16 and the width of the retaining straps 9 can be adjusted depending on how much additional support is desired. For example, the width of the retaining straps 9, particularly near the bottom of the strap may be increased or decreased. Similarly, the bottom of the stabilizer panels 16 may extend across all or part of the width of the cups 1. This configuration of the retaining straps 9 and the stabilizer panels 16 beneficially prevents the bra from sliding around the breasts without requiring an underwire.

Figure 13:
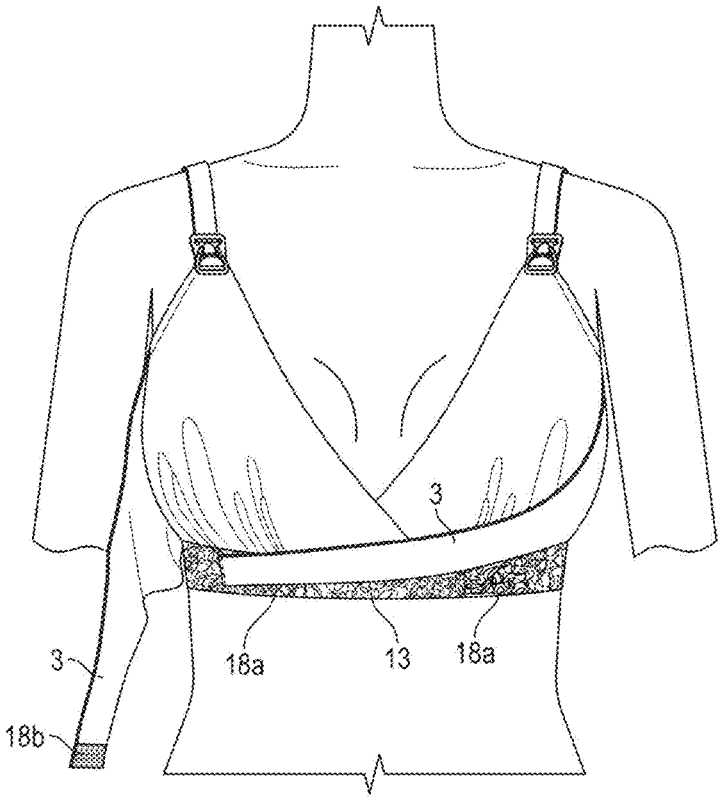
FIG. 13 is a front perspective view of one support wing when opened according to the present disclosure.

FIG. 13 is a front view of the nursing bra showing an example configuration of the support wings 3 and their attachment to the bottom band 6 via a band fastener 11, preferably comprising Velcro® (hook and loop fastener). Preferably, the soft Velcro® (loop fastener) 18*a* is attached to the bottom band 6 on at least two discrete points on the bottom band 6 and still more preferably in a long piece spanning the front of the torso or the circumference of the torso. The hook Velcro® (hook fastener) 18*b* is attached near the terminal point of the support wings 3. The hook Velcro® (hook fastener) 18*b* on the support wings 3 may thereby attach to the soft Velcro® (loop fastener) 18*a* of the bottom band 6 under the breasts, providing support for the breasts and modifying the cup volume. In some embodiments, the soft Velcro® (loop fastener) 18*a* has a length long enough to permit adjustments to the extent of breast support and cup volume. For example, the soft Velcro® (loop fastener) 18*a* band has a length such that the support wings 3 can be attached to the bottom band 6 closer to the center front of the bra in a looser configuration, where less support or more cup volume is desired, and the support wings 3 can also be attached to the bottom band 6 closer to back wings 15 (not shown), where more support or less cup volume is desired. In such a case, the soft Velcro® (loop fastener) 18*a* may have a longer length than the hook Velcro® (hook fastener) 18*b*. For example, the soft Velcro® (loop fastener) 18*a* may be about three inches long (or longer), while the hook Velcro® (hook fastener) 18*b* may be about ⅝ inches long. The support wings 3 can be opened while breastfeeding or closed to provide continuing extra support to the breasts.

Figure 14:
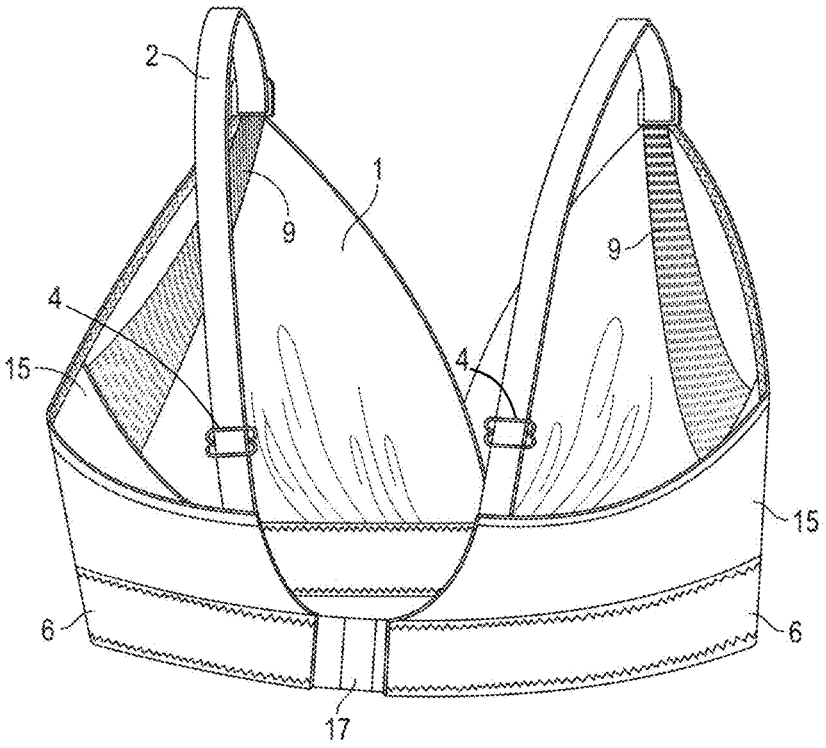
FIG. 14 is a rear perspective view of the inside of the adjustable cup and support system nursing bra according to the present disclosure.

FIG. 14 depicts a rear perspective view of the adjustable nursing bra and support. According to this embodiment, the bra includes two retaining straps 9 and two stabilizer panels 16 attached to each of the cups 1. The bra further includes two back wings 15 on either side of the bra. The back wings 15 are connected to the bottom band 6 together with one or more of the cups 1, stabilizer panels 16, and retaining straps 9. The back wings 15 also connect to the back of the shoulder straps 2 which are adjustable via the strap length adjusters 4. The back wings terminate in the rear of the bra with a hook and eye closure system 17 or comparable fastener. The hook and eye closure system 17 comprises, for example, one or more columns of eye loops, wherein each column comprises one or more eye loops; and one or more columns of hooks, wherein each column comprises one or more hooks. Generally, the eyes are on the right side of the garment and the hooks are on the left. The hook and eye closure system 17 may be made of any suitable materials, for example, nylon tricot with bonded edges and metal hardware. In some embodiments, the hook and eye closure system 17 has a plush back for comfort. Additionally, the hooks and eyes can be zigzagged over the edge to reduce irritation from the fuse cut edges for sensitive skin. The cups 1 may be lined such that the retaining straps 9 and stabilizer panels 16 are positioned between the two layers of the cups 1.

Adjustable Nursing Bra with Support System and Skirt

In addition to adjustability and support, the nursing bra described herein may further include a nursing bra with a skirt that can be size-adjusted in four directions and can also be used as a bra top for daily use. More particularly, the adjustable nursing bra is a size adjustable nursing bra that can be easily opened through the front of the skirt closed via a closure system. The skirt is preferably an waistband that overlaps at the front to provide full coverage. Additionally, in some embodiments, the skirt beneficially includes part of a bra clasp set (for example the top component of the bra clasp set) such that the skirt can be clipped to hang from the bra clasp on the front shoulder strap. This is designed to prevent the baby from being covered by the fabric when the cup opens down, thereby improving the quality of the feed and avoiding safety issues. The nursing bra with a skirt is designed to provide a nursing bra with a skirt that is both functional and stylish. The gathered skirt allows this nursing camisole to be used either as a nursing nightgown or as a nursing bra top or dress for wearing during the day. Significantly, the nursing bra with a skirt provides a variety of ways to open the bra for breastfeeding so the wearer can choose the most suitable and comfortable configuration for breastfeeding. The four ways of opening include opening the bra from top to bottom and opening from the center to the side. In some embodiments, the adjustable nursing bra with a skirt also includes a support panel that provides support to the breasts while breastfeeding.

The adjustable nursing bra with a skirt is adjustable to a variety of sizes as the wearer can adjust, for example, the connections between shoulder straps and cups. Beneficially, the nursing bra allows the wearer to adjust cup sizes according to natural breast size changes in the wearer's postpartum body. The support panel underneath the cups not only provides good breast support for comfort and breast shape aesthetics but also plays the role of connecting the waistband of the skirt, which prevents the skirt from falling when the clasp system connecting the cup and the shoulder strap is opened. The waistband that overlaps at the front of the bra can also be clipped to hang from the clasp system on the front of the shoulder straps. This clipping capability is designed to prevent the infant from being covered by the fabric of the skirt when the cup opens down.

Figure 15A:
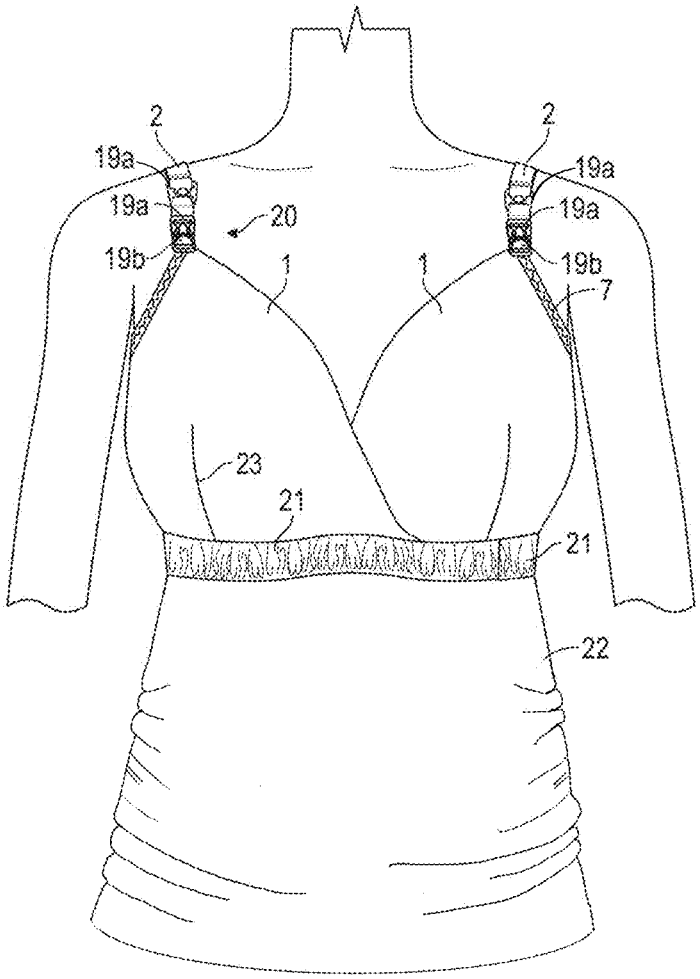
FIGS. 15A-15C are a front view of an adjustable nursing bra with a skirt, in which two adjustable buckles of a suitable size are in a closed position and two wings are attached to the bands.

Referring now to the figures, FIG. 15*a* is a perspective view of the front of the adjustable nursing bra with a skirt 22 according to the present disclosure. As used herein, the term "skirt" refers to the portion of the garment below the bra. In FIG. 15*a*, the garment has two bra cups 1, a cup support 7 behind each bra cup 1, two shoulder straps 2, and two clasp sets 20 on each shoulder strap 2. Each clasp set according to the embodiment in FIG. 15*a* comprises two bottom components 19*a* and one top component 19*b*. The top component of the clasp 19*b* can therefore be attached to one of two bottom components 19*a*. The bottom components 19*a* may positioned at different heights on the shoulder straps 2 such that one bottom component 19*a* is higher than the other bottom component 19*a*, thereby permitting the wearer to attach the top component 19*b* to either the higher bottom component 19*a* or lower bottom component 19*a* to adjust the size and volume of the cups 1. The garment further comprises an waistband 21, wherein one part of the waistband 21 is attached to the bottom of the cups 1, and a skirt 22 attached at a waistband 21. The waistband 21 may be a waistband such that the skirt 22 is an empire waist garment. However, in an embodiment, the skirt 22 is fitted, such that the nursing bra is incorporated into a shirt. In such embodiments, the skirt 22 optionally has ruching on the sides to accommodate for changing torso size during pregnancy. The skirt 22 may be of any suitable material and length. For example, the skirt 22 may be of a length such that the garment can be worn as a top. In some embodiments, the cups 1 have one or more seamlines 23, preferably a vertical seamline such as a dart, beginning at the bottom of the cups 1 and rising vertically towards the wearer's shoulders to better accommodate the shape and size of the breasts.

Figure 15B:
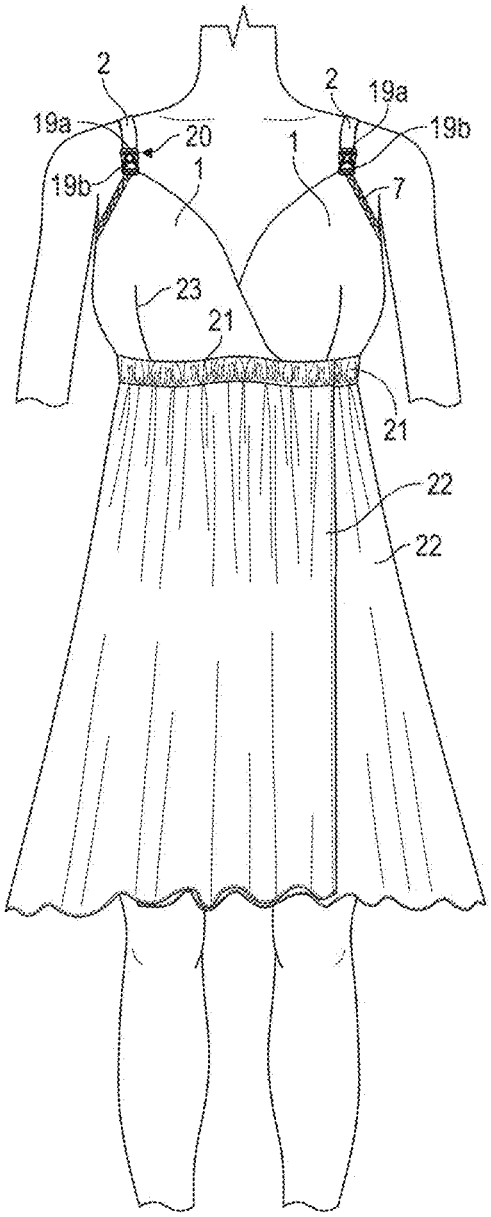
Figure 15C:
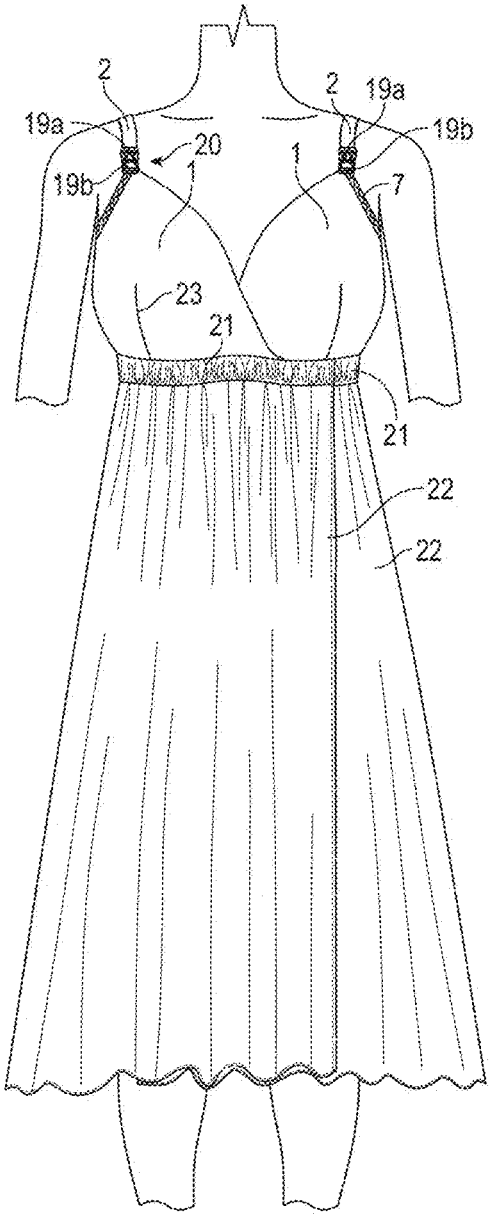

Alternatively, as shown in FIG. 15*b* and FIG. 15*c* the skirt 22 may be of a length such that the garment can be worn as a knee-length or floor-length nightgown or dress. In FIG. 15*b* and FIG. 15*c*, the garment has two bra cups 1, two shoulder straps 2, and two clasp sets 20 on each shoulder strap 2. Each clasp set according to the embodiment in FIG. 15*b* comprises two bottom components 19*a* and one top component 19*b*. The top component of the clasp 19*b* can therefore be attached to one of two bottom components 19*a*. The bottom components 19*a* may positioned at different heights on the shoulder straps 2 such that one bottom component 19*a* is higher than the other bottom component 19*a*, thereby permitting the wearer to attach the top component 19*b* to either the higher bottom component 19*a* or lower bottom component 19*a* to adjust the size and volume of the cups 1. The garment further comprises a waistband 21, wherein one part of the waistband 21 is attached to the bottom of the cups 1, and a skirt 22 attached a waistband 21.

The bra cups 1 may be overlapped as much or as little as is desired. For example, if the nursing bra with a skirt will be worn as a top or dress during the day, more overlap may be desirable. Accordingly, in some embodiments, the cups 1 have one or more seamlines 23, preferably a vertical seamline such as a dart, beginning at the bottom of the cups 1 and rising vertically towards the wearer's shoulders to better accommodate the shape and size of the breasts. The nursing bra with a skirt 22 may include cup supports 7 supporting the sides of the breasts. Alternatively or in addition to cup supports 7, the bra may include decorative components such as lace or silk. Further, it is preferable that the nursing bra with a skirt 22 include two layers of fabric on the cups 1 to give more protection and support to the breasts.

Figure 16:
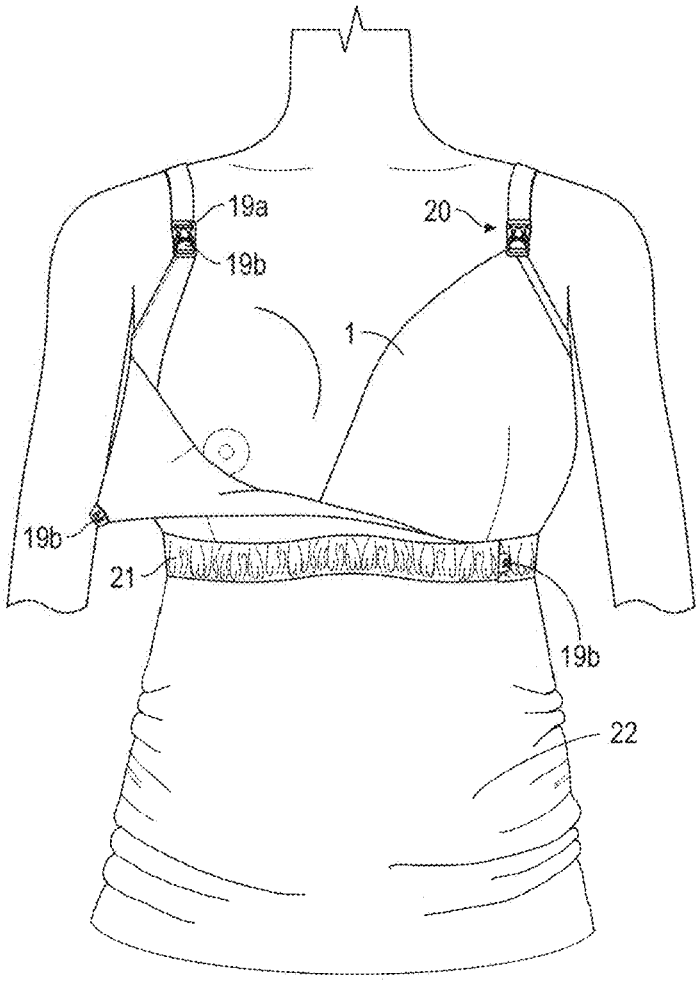
FIG. 16 is a front view of the nursing bra with a skirt showing an opening cup at the shoulder clip closure.

FIG. 16 is a front perspective of the adjustable nursing bra with a skirt wherein one of the cups is opened but the skirt remains closed. This embodiment shows in part how the two bra cups 1 are overlapped and may be of any variable size to properly fit the breasts. The bra cups are wire-free. The bra cups 1 can be opened via the clasp sets 20, located at the shoulder straps 2. The cups 1 can be flipped down to expose the breast while breastfeeding The waistband 21 is configured to provide support to the cups 1, hold the shape of the cups 1, and connect the cups 1 with the skirt 22. Each clasp set 20 according to the embodiment in FIG. 16 comprises two bottom components 19*a* and one or two top components 19*b*. The top component of the clasp 19*b* can be attached to one of two bottom components 19*a*. The bottom components 19*a* may positioned at different heights on the shoulder straps 2 such that one bottom component 19*a* is higher than the other bottom component 19*a*, thereby permitting the wearer to attach the top component 19*b* to either the higher bottom component 19*a* or lower bottom component 19*a* to adjust the size and volume of the cups 1. In particular, the clasp set 20 on the wearer's right shoulder comprises two bottom components 19*a*, and two top components 19*b*. Either one of the top components 19*b* can be connected to either one of the bottom components 19*a* to open the garment from left to right. For example, the top component 19*b* attached to the cup 1 can be connected with the lower bottom component of the clasp 19*a*. The top component of the clasp 19*b* attached to the waistband 21 can be connected with the higher bottom component of the clasp 19*a*.

Figure 17:
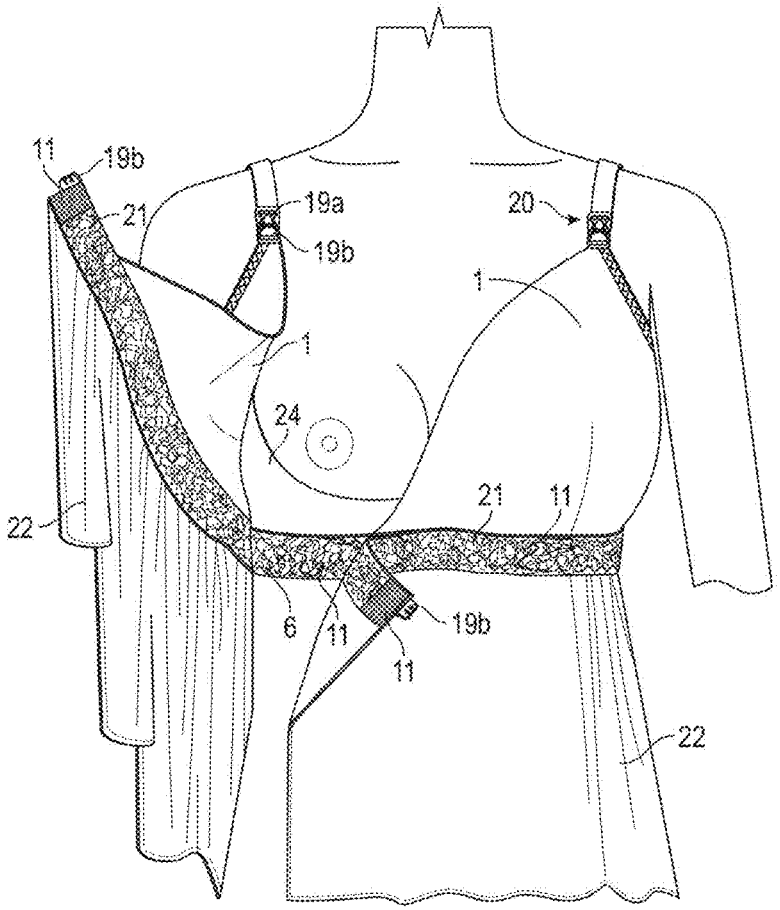
FIG. 17 is a front view of the nursing bra with a skirt, showing an opening cup on the wearer's right side detached from the waistband, and the configuration of an example Velcro® (hook and loop fastener) band attachment system.

FIG. 17 is a front perspective view of the support bra with a skirt showing the skirt 22 and empire waist opened on the wearer's right side to reveal the support panel 24. The bra cups 1 can be opened via the waistband 21. A band fastener 11 such as Velcro® (hook and loop fastener) is used to secure the ends of the waistband 21 to the support panel 24. The waistband 21 can be adjusted to fit around the torso by use of the band fastener 11. The waistband 21 is attached to the bottom band 6 of the support panel 24 using a band fastener 11 such as Velcro® (hook and loop fastener). Each end of the waistband 21 may include a top component 19*b* part of a clasp set 20, permitting the waistband 21 and skirt 22 to attach to one of the bottom components 19*a* of the clasp set 20.

Figure 18:
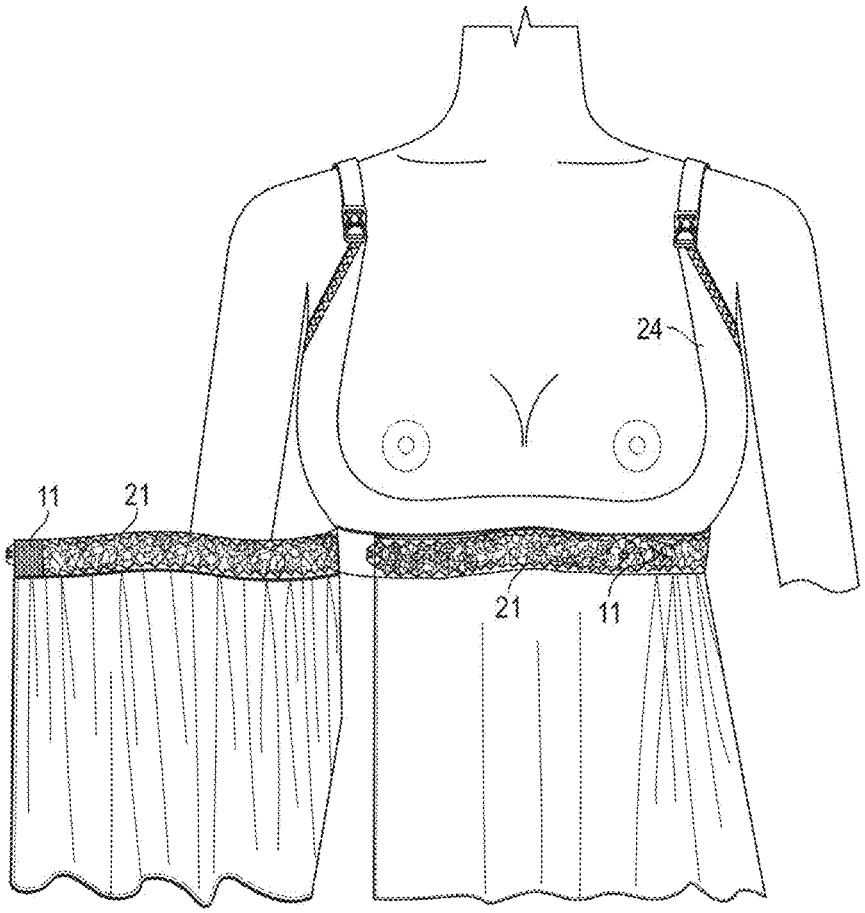
FIG. 18 is a front view of the nursing bra with a skirt shown, showing the front opening at the waistband with an example Velcro® (hook and loop fastener) closure system and a one-piece liner underneath the bra cups.

FIG. 18 illustrates the configuration of the support panel 24. The support panel 24 may be made of any suitable strong and stretchy fabric and preferably comprises two layers of fabric. In a preferred embodiment, the support panel 24 is comprised of double layers of power mesh. The support panel 24 is preferably configured as a one-piece panel that attaches to the cups 1 (not shown) and the back wings 15 (not shown) at the side seam of the bra. The bottom band 6 of the support panel 24 is also attached to the waistband 21 and by extension the skirt 22. The support panel 24 is configured to hold the shoulder straps 2 while the cups 1 are opened and flipped down for breastfeeding. A purpose of the support panel 24 is to provide extra support to the breasts while breastfeeding. Preferably the skirt 22 is gathered and attached to the waistband 21 to provide more room for the wearer and allow the garment to fit throughout body weight and shape changes during pregnancy and the postpartum period. The band fastener 11 of the waistband 21 also permits adjustments of the bra to better fit the wearer.

Figure 19:
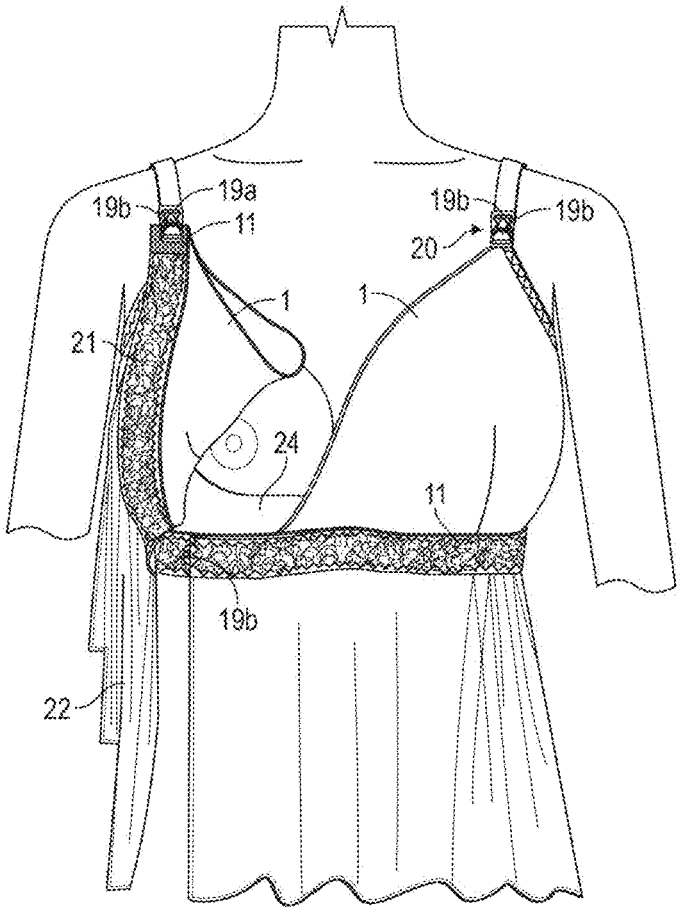
FIG. 19 is a front view of the nursing bra with a skirt, showing the wearer's right side cup and skirt attached at the clasp system on the front shoulder strap.

FIG. 19 illustrates the configuration of attaching an opened cup 1 to the clasp set 20, particularly attaching the top component of the clasp 19*b* attached to the waistband 21 to the bottom component of the clasp 19*a* such that the cup 1 waistband 21 and skirt 22 are on the wearer's side. This configuration can prevent the fabric from covering the nursing infant's face while breastfeeding when the cup 1 is opened at the front. As shown in FIG. 19, when one half of the waistband 21 and/or the skirt 22 are attached to the clasp set 20 on the wearer's shoulder, the other half of the waistband 21 and skirt 22 may remain attached to the bottom band 6 of the support panel 24 by way of the band fastener 11 for privacy and increased coverage. The support panel 24 supports the base of the breasts and provides an ideal breast shape aesthetically and for breastfeeding.

Figure 20A:
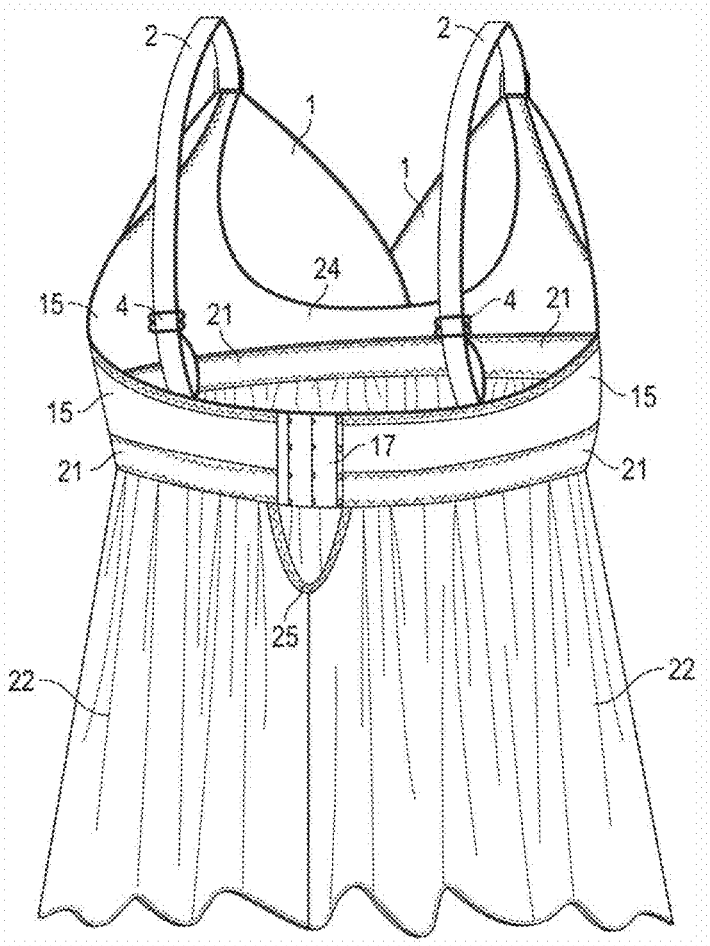
FIG. 20A is a rear view of the nursing bra with a skirt and a hook and eye closure.

FIG. 20A is a rear perspective of the supported nursing bra with a skirt. The cups 1 are attached to the shoulder straps 2 and support panel 24. The support panel 24 in turn is attached to the waistband 21 and back wings 15 on either side of the bra. The waistband 21 and back wings 15 extend around the back of the wearer and terminate in the rear of the bra with a hook and eye closure system 17 or comparable fastener. The hook and eye closure system 17 comprises, for example, one or more columns of eye loops, wherein each column comprises one or more eye loops; and one or more columns of hooks, wherein each column comprises one or more hooks. Generally, the eyes are on the right side of the garment and the hooks are on the left. The hook and eye closure system 17 may be made of any suitable materials, for example, nylon tricot with bonded edges and metal hardware. In some embodiments, the hook and eye closure system 17 has a plush back for comfort. Additionally, the hooks and eyes can be zigzagged over the edge to reduce irritation from the fuse cut edges for sensitive skin.

Figure 20B:
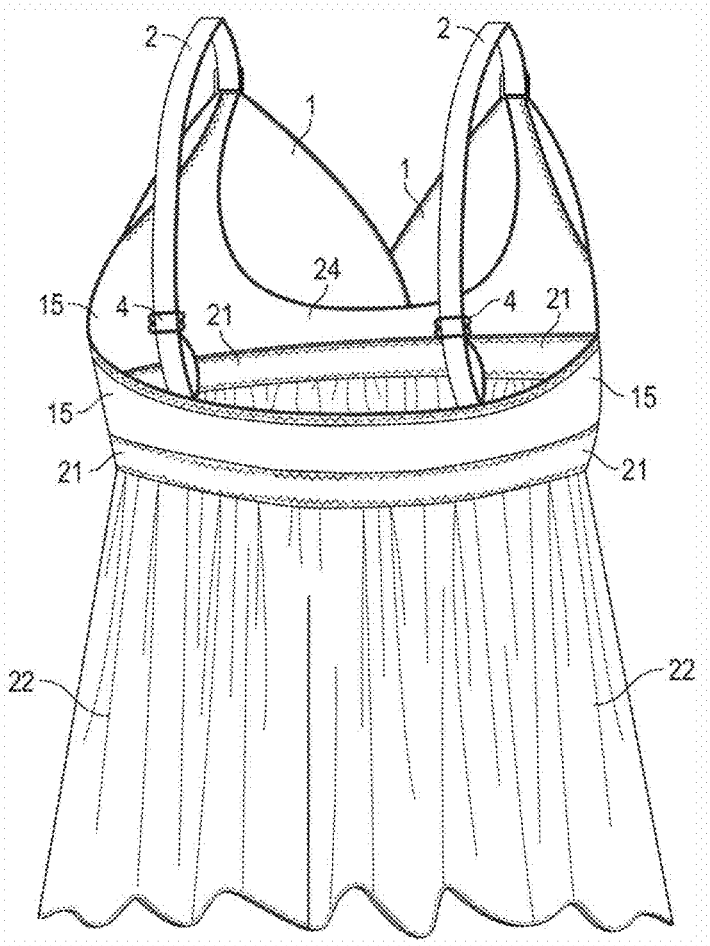
FIG. 20B is a rear view of the nursing bra with a skirt and continuous elastic band.

FIG. 20B is a rear perspective of the supported nursing bra with a skirt. The cups 1 are attached to the shoulder straps 2 and support panel 24. The support panel in turn is attached to the waistband 21 and back wings 15 on either side of the bra. The waistband 21 and back wings 15 extend around the back of the wearer and terminate in the rear of the bra.

In FIG. 20A and FIG. 20B, the waistband 21 is attached at its base to the skirt 22. The skirt may of any suitable length, for example of a length such that the nursing bra may be worn as a bra, a top, a knee-length dress, or a floor-length dress. There is a keyhole 25 at the center back of the skirt 22, below the hooks and eye closure system 17. This configuration provides further flexibility of the skirt 22 so the wearer has extra room available for the skirt 22 and so the wearer can adjust the fit around the torso using the hook and eye closure system 17.

The nursing bra with skirt has shoulder straps 2 of any suitable length and width including, without limitation, a width of 5/16 inches, 3/8 inches, 1/2 inches, 3/4 inches, and the like. To determine the size of the shoulder straps 2, the width of the shoulder straps 2 should be wide enough to hold the weight of the mother's breasts across the shoulders without cutting into the skin. The shoulder straps 2 are connected to the support panel 24 and cups 1 at the point of the clasp sets 20 and further in the back of the nursing bra at the top of the back wings 15. The shoulder straps 2 further comprise strap length adjusters 4 to permit the wearer to modify the length of the straps.

Materials & Sizing

The materials used in the adjustable nursing bras described herein may be made of any suitable material. Preferred fabrics include, but are not limited to, stretch materials such as cotton, spandex, nylon, polyester, acrylic, silk, lace, bamboo jersey, rayon, and other textile yarns, or combinations thereof, such as cotton-spandex blends, spandex-nylon blends, spandex-polyester blends, bamboo-rayon blends, and the like. Fabrics with less stretch can even be used for as desired for some parts of the bra, including cotton and LYCRA® blends, spandex single jersey knits, or a combination thereof. For example, single jersey knit may be used to form the breast supporting cup and to form or reinforce back portions of the bra. The fabric used for the inner lining of the cups or other parts of the bra may comprise softer fabrics, for example, a bamboo-rayon blend. Mesh or other strong materials may be used for any part of the bra where additional support is desirable. For example, the fabric of the support wings could be comprised of two materials: stretch lace as the outer layer and power mesh as the lining.

The adjustable bras disclosed herein may be provided in any suitable cup size or band size, such as cup size AAA, AA, A, B, C, D, E, F, G, H, I, J, and the like, and band sizes of 22 inches, 24 inches, 26 inches, 28 inches, 30 inches, 32 inches, 34 inches, 36 inches, 38 inches, 40 inches, 42 inches, 44 inches, 46 inches, 48 inches, and the like. It is noted that the adjustable bras are provided with a base size, but can be adjusted to accommodate other sizes. For example, an adjustable bra disclosed herein may be manufactured with a size C cup and a 34 inch band size, but the bra permits adjustments to cup sizes B-D, and band widths of 32-36 inches.

Figure 21:
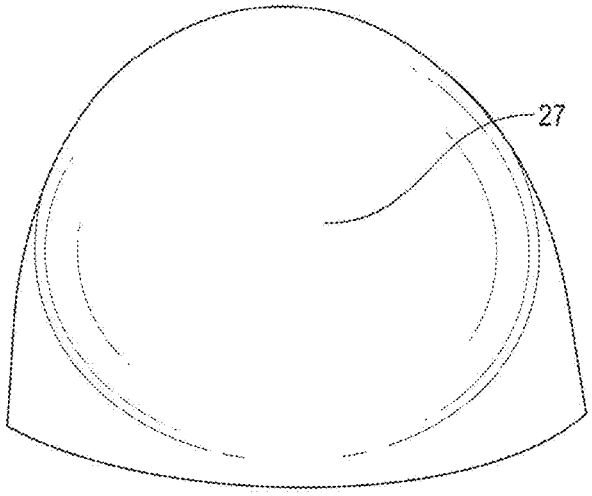
FIG. 21 depicts an example of a removable cup 27 that can be inserted into, or removed from, the cups (not shown) via the cup openings (not shown).

As shown in FIG. 21, the adjustable nursing bras disclosed herein may also include one or more removable pads 27 which can be inserted into, or removed from, the cups 1 (not shown) specifically between the liner of the cup 1 and the outer layer of the cup 1. The removable pads 27 can be inserted or removed based on the wearer's preferences and comfort. For example, the removable pads 27 may be inserted during the day and removed during the night.

Figure 22:
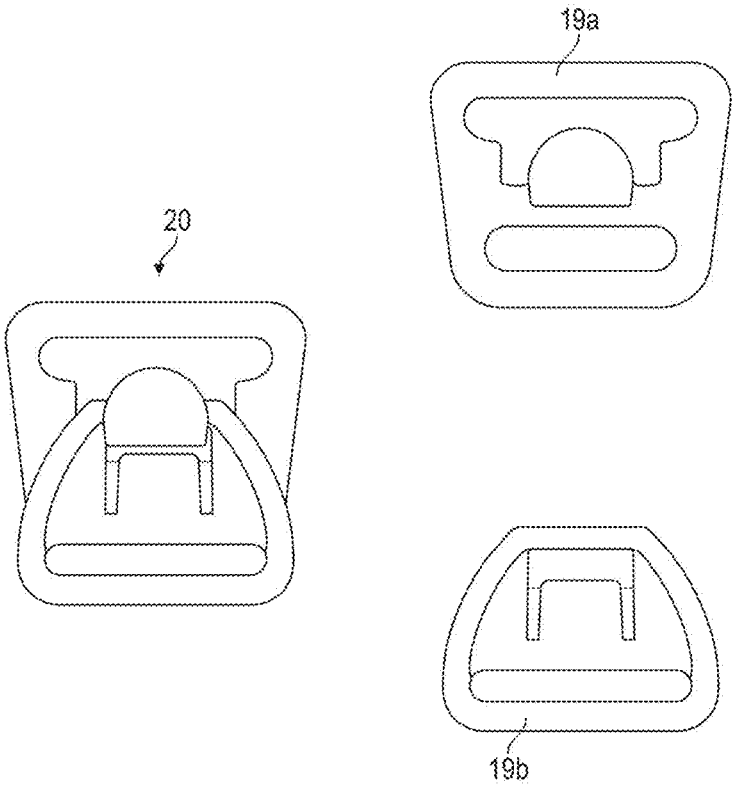
FIG. 22 shows an example of a suitable type of clasp set for the nursing bras disclosed herein. Specifically.
Figure 23:
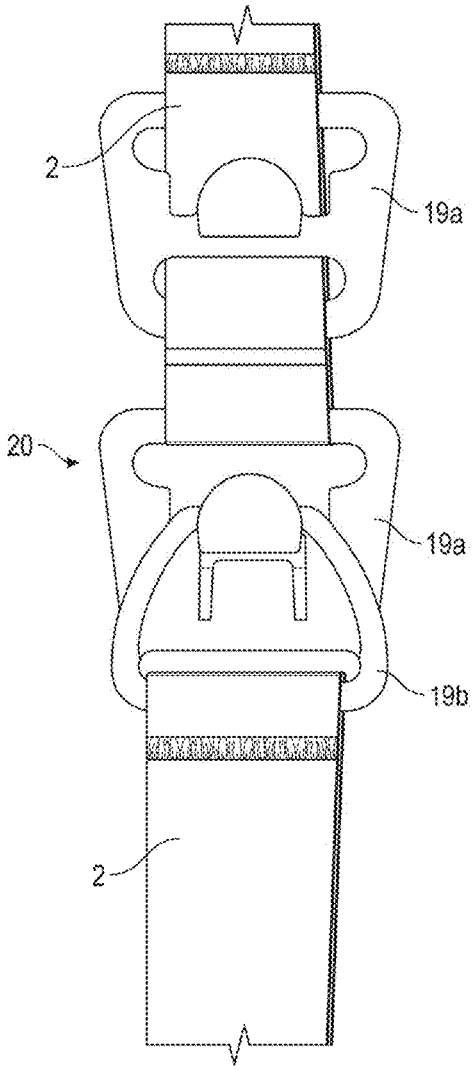
FIG. 23 shows an additional example of a suitable type of clasp set for the nursing bras disclosed herein, wherein each clasp set comprises two bottom components of the clasp 19*a* and one top component of the clasp 19*b*.

FIG. 22 and FIG. 23 provide examples of suitable clasp systems for the adjustable nursing bras described herein. depicts an example of a removable cup 27 that can be inserted to, or removed from the cups (not shown) via the cup openings (not shown). Specifically, FIG. 22 shows the top component of the clasp 19*b* and the bottom component of the clasp 19*a* separately, and also the clasp set 20 when the top component of the clasp 19*b* and the bottom component of the clasp 19*a* are joined. This clasp system is preferably used for the adjustable nursing bra and/or the adjustable nursing bra with a support system.

FIG. 23 shows an additional example of a suitable type of clasp set for the nursing bras disclosed herein, wherein each clasp set comprises two bottom components of the clasp 19*a* and one top component of the clasp 19*b*. In FIG. 23, the top component of the clasp 19*b* is connected with the lower bottom component of the clasp 19*a*, while the upper bottom component of the clasp 19*a* remains free. Optionally, to facilitate adjustment of the cup 1 (not shown) size, the top component of the clasp 19*b* can be connected with the upper bottom component of the clasp 19*a*. Alternatively or in addition to this configuration, the skirt 22 (not shown) and/or fabric of the cup 1 (not shown) can be connected to the upper bottom component of the clasp 19*a* by way of a top component 19*b* attached to the waistband 21 (not shown). This clasp system is preferably used for the adjustable nursing bra with a support system and a skirt.

From the foregoing, it can be seen that the present disclosure accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are ubiquitous within the art can replace or supplement any element identified by another reference character.

TABLE 1

| List of Reference Characters | |
|---|---|
| 1 | Bra cup |
| 2 | Shoulder strap |
| 3 | Support wing |
| 4 | Strap length adjuster |
| 5 | Cup gathering |
| 6 | Bottom band |
| 7 | Cup support |
| 8 | Opening |
| 9 | Retaining strap |
| 10 | Support belt |
| 11 | Band fastener |
| 12 | Continuous wing |
| 13 | Elastic belt |
| 14 | Elastic band |
| 15 | Back wing |
| 16 | Stabilizer panel |
| 17 | Hook and eye closure system |
| 18a | Soft Velcro |
| 18b | Hook Velcro |
| 19a | Bottom component of the clasp |
| 19b | Top component of the clasp |
| 20 | Clasp set |
| 21 | Waistband |
| 22 | Skirt |
| 23 | Seamline |
| 24 | Support panel |
| 25 | Key hole |
| 26 | Cup opening |
| 27 | Removable pad |

EXAMPLES

Example 1

The garments described herein were evaluated by a test group of individuals. Pregnant and/or breastfeeding testers of varying band and breast size were asked to wear and use the nursing bras as described herein. The testers were then asked a series of questions and asked to rank the garments on a scale of 1-7, wherein 1 corresponded to "strongly disagree" and 7 corresponded to "strongly agree."

TABLE 2

Review of Nursing Bras

| Question | Style 1: Average Rank | Style 2: Average Rank | Total Average Rank |
|---|---|---|---|
| The bra cups cover my breasts well | 5.7 | 5.7 | 5.7 |
| The bra does not appear to irritate my skin | 5.2 | 5.3 | 5.25 |
| The fabric appears to be breathable | 5.8 | 5.8 | 5.8 |
| The bra fits well | 3.8 | 4.2 | 4 |
| The shoulder straps appear comfortable | 5.5 | 5.5 | 5.5 |
| The bra is easy to put on | 5.2 | 3.8 | 4.5 |
| The bra is easy to take off | 5.2 | 5.5 | 5.35 |
| I prefer to use the clipped closer on the shoulder strap during breastfeeding | 5.8 | 6.0 | 5.9 |
| I like the shape of the supporting liner that Is attached with the bra cups | 5.0 | 4.8 | 4.9 |
| The supporting liner does support my breasts | 4.8 | 3.8 | 4.3 |
| The elastic on the bottom band is comfortable | 5.6 | 4.2 | 4.9 |
| The bra would maintain my privacy while breastfeeding | 3.6 | 5.4 | 4.5 |
| I would feel comfortable wearing this bra while I was sleeping | 6.2 | 5.0 | 5.6 |
| I would feel comfortable working/leaving the house while wearing this bra with the pads | 5.0 | 5.7 | 5.35 |
| I would feel comfortable working/leaving the house while wearing this bra without the pads | 2.8 | 5.5 | 4.15 |
| Having the pads inserted in the cup made me feel more confident wearing the bra | 5.8 | 5.5 | 5.65 |
| I would wear this bra during my entire breastfeeding period | 4.3 | 3.8 | 4.05 |
| I would wear this bra instead of wearing the current nursing bra | 3.3 | 4.8 | 4.05 |
| I would recommend this bra to friends that are breastfeeding | 4.3 | 4.3 | 4.3 |

What is claimed is:

1. A garment comprising:

a bottom band, the bottom band comprising a first detachable portion connected to the bottom band, a second detachable portion connected to the bottom band, and an opening;

a first cup connected to the bottom band;

a second cup connected to the bottom band;

a first shoulder strap releasably connected to the first cup by a first clasp set;

a second shoulder strap releasably connected to the second cup by a second clasp set;

one or more supports comprising a continuous wing and a support belt; and one or more band fasteners comprising a first band fastener and a second band fastener, wherein the one or more band fasteners are configured to connect the first detachable portion of the bottom band and the second detachable portion of the bottom band to the bottom band;

wherein the first detachable portion of the bottom band passes through the opening and is releasably connected to the bottom band via the first band fastener; and wherein the second detachable portion of the bottom band passes over the first detachable portion of the bottom band and is releasably connected to the bottom band via the second band fastener.

2. The garment of claim 1, further comprising an elastic band which connects the bottom band.

3. The garment of claim 2, further comprising a first cup support and a second cup support.

4. The garment of claim 3, wherein the first clasp set comprises a first bottom component attached to the first shoulder strap and the first cup support, and a first top component attached to the first cup; and wherein the second clasp set comprises a second bottom component attached to the second shoulder strap and the second cup support, and a second top component attached to the second cup.

5. The garment of claim 1, wherein the garment further comprises an elastic belt attached to the first detachable portion of the bottom band and the second detachable portion of the bottom band.

* * * * *